US009082261B2

(12) United States Patent
Caputo et al.

(10) Patent No.: US 9,082,261 B2
(45) Date of Patent: Jul. 14, 2015

(54) GAMING SYSTEM AND METHOD EMPLOYING A PLAYER-SELECTED FEATURE FOR A PLAY OF A GAME OR USING THE PLAYER-SELECTED FEATURE TO MODIFY ANOTHER FEATURE FOR A SUBSEQUENT PLAY OF THE GAME

(71) Applicant: IGT, Reno, NV (US)

(72) Inventors: Scott A. Caputo, Santa Clara, CA (US); Brian F. Saunders, Sunnyvale, CA (US)

(73) Assignee: IGT, Las Vegas, NV (US)

( * ) Notice: Subject to any disclaimer, the term of this patent is extended or adjusted under 35 U.S.C. 154(b) by 123 days.

(21) Appl. No.: 13/886,984

(22) Filed: May 3, 2013

(65) Prior Publication Data

US 2014/0329590 A1 Nov. 6, 2014

(51) Int. Cl.

| | |
|---|---|
| ***A63F 9/24*** | (2006.01) |
| ***G07F 17/32*** | (2006.01) |
| *G07F 17/34* | (2006.01) |

(52) U.S. Cl.

CPC ..... *G07F 17/3267* (2013.01); *G07F 17/32* (2013.01); *G07F 17/3258* (2013.01); *G07F 17/3262* (2013.01); *G07F 17/3244* (2013.01); *G07F 17/34* (2013.01)

(58) Field of Classification Search

CPC ..... G07F 17/32; G07F 17/3244; G07F 17/34; G07F 17/3267; G07F 17/3262; G07F 17/3258; A63F 9/24

USPC ..... 463/16–21

See application file for complete search history.

(56) References Cited

U.S. PATENT DOCUMENTS

| | | | |
|---|---|---|---|
| 4,099,722 | A | 7/1978 | Rodesch et al. |
| 4,335,809 | A | 6/1982 | Wain et al. |
| 4,363,486 | A | 12/1982 | Chaudhry et al. |
| 4,527,798 | A | 7/1985 | Siekierski et al. |
| 4,695,053 | A | 9/1987 | Vazquez et al. |
| 4,718,672 | A | 1/1988 | Okada |
| 5,024,439 | A | 6/1991 | Okada et al. |
| 5,127,651 | A | 7/1992 | Okada et al. |
| 5,410,344 | A | 4/1995 | Graves et al. |
| 5,429,361 | A | 7/1995 | Raven et al. |
| 5,720,662 | A | 2/1998 | Holmes et al. |
| 5,803,809 | A | 9/1998 | Yoseloff |
| 5,823,873 | A | 10/1998 | Moody et al. |
| 5,833,536 | A | 11/1998 | Davids et al. |
| 5,841,428 | A | 11/1998 | Jaeger et al. |
| 5,851,148 | A | 12/1998 | Brune et al. |
| 5,851,149 | A | 12/1998 | Xidos et al. |
| 5,882,261 | A | 3/1999 | Adams et al. |
| 5,936,613 | A | 8/1999 | Jaeger et al. |

(Continued)

*Primary Examiner* — Justin Myhr

(74) *Attorney, Agent, or Firm* — Neal, Gerber & Eisenberg LLP

(57) ABSTRACT

Various embodiments of the present disclosure are directed to a gaming system and method providing a game employing a player-selected one of a plurality of different features. In one embodiment, the gaming system is configured to operate a game associated with a set of a plurality of different features, and enables a player to select one of the features for a play of the game. In certain instances, the gaming system provides the play of the game in accordance with the selected feature. In other instances, the gaming system provides the play of the game without the selected feature, and uses the selected feature to modify one of the other, non-selected features that has a designated relationship with the selected feature. The gaming system subsequently enables the player to select the modified feature for a subsequent play of the game.

20 Claims, 28 Drawing Sheets

(56) References Cited

U.S. PATENT DOCUMENTS 5,951,011 A 9/1999 Potter et al.
5,951,397 A 9/1999 Dickinson
5,966,125 A 10/1999 Johnson
5,967,896 A 10/1999 Jorasch et al.
5,971,271 A 10/1999 Wynn et al.
5,971,850 A 10/1999 Liverance
5,990,885 A 11/1999 Gopinath
5,993,316 A 11/1999 Coyle et al.
6,004,211 A 12/1999 Brenner et al.
6,010,404 A 1/2000 Walker et al.
6,012,983 A 1/2000 Walker et al.
6,028,604 A 2/2000 Matthews et al.
6,062,980 A 5/2000 Luciano
6,062,981 A 5/2000 Luciano
6,068,101 A 5/2000 Dickenson et al.
6,068,552 A 5/2000 Walker et al.
6,070,878 A 6/2000 Jones et al.
6,077,163 A 6/2000 Walker et al.
6,089,975 A 7/2000 Dunn
6,099,408 A 8/2000 Schneier et al.
6,106,393 A 8/2000 Sunaga et al.
6,110,041 A 8/2000 Walker et al.
6,113,495 A 9/2000 Walker et al.
6,126,542 A 10/2000 Fier
6,152,822 A 11/2000 Herbert
6,155,925 A 12/2000 Giobbi et al.
6,159,097 A 12/2000 Gura et al.
6,162,121 A 12/2000 Morro et al.
6,164,645 A 12/2000 Weiss
6,174,233 B1 1/2001 Sunaga et al.
6,174,235 B1 1/2001 Walker et al.
6,203,010 B1 3/2001 Jorasch et al.
6,203,427 B1 3/2001 Walker et al.
6,203,429 B1 3/2001 Demar et al.
6,224,482 B1 5/2001 Bennett
6,224,483 B1 5/2001 Mayeroff
6,227,969 B1 5/2001 Yoseloff
6,227,970 B1 5/2001 Shimizu et al.
6,231,442 B1 5/2001 Mayeroff
6,231,445 B1 5/2001 Acres
6,234,897 B1 5/2001 Frohm et al.
6,241,608 B1 6/2001 Torango
6,270,409 B1 8/2001 Shuster
6,293,866 B1 9/2001 Walker et al.
6,299,165 B1 10/2001 Nagano
6,302,790 B1 10/2001 Brossard
6,309,300 B1 10/2001 Glavich
6,315,662 B1 11/2001 Jorasch et al.
6,315,663 B1 11/2001 Sakamoto
6,315,666 B1 11/2001 Mastera et al.
6,319,125 B1 11/2001 Acres
6,322,309 B1 11/2001 Thomas et al.
6,325,375 B1 12/2001 Potter et al.
6,342,901 B1 1/2002 Adler et al.
6,343,988 B1 2/2002 Walker et al.
6,346,043 B1 2/2002 Colin et al.
6,346,044 B1 2/2002 McCrea, Jr.
6,347,996 B1 2/2002 Gilmore et al.
6,350,199 B1 2/2002 Williams et al.
6,354,943 B1 3/2002 Miura
6,375,567 B1 4/2002 Acres
6,394,899 B1 5/2002 Walker
6,398,217 B1 6/2002 Shimizu et al.
6,435,970 B1 8/2002 Baerlocher et al.
6,439,993 B1 8/2002 O'Halloran
6,439,995 B1 8/2002 Hughs-Baird et al.
6,475,087 B1 11/2002 Cole
6,511,377 B1 1/2003 Weiss
6,517,437 B1 2/2003 Wells et al.
6,520,308 B1 2/2003 Martin et al.
6,520,856 B1 2/2003 Walker et al.
6,533,663 B1 3/2003 Iwao et al.
6,554,709 B1 4/2003 Brenner et al.
6,565,434 B1 5/2003 Acres
6,592,457 B1 * 7/2003 Frohm et al. ..... 463/16
6,605,002 B2 8/2003 Baerlocher
6,609,969 B1 8/2003 Luciano et al.
6,609,970 B1 8/2003 Luciano, Jr.
6,645,068 B1 11/2003 Kelly et al.
6,659,864 B2 12/2003 McGahn et al.
6,712,698 B2 3/2004 Paulsen et al.
6,719,631 B1 4/2004 Tulley et al.
6,758,757 B2 7/2004 Luciano, Jr. et al.
6,769,688 B1 8/2004 Lean
6,769,982 B1 8/2004 Brosnan
6,776,714 B2 8/2004 Ungaro et al.
6,832,959 B2 12/2004 Baerlocher
6,835,133 B2 12/2004 Baerlocher et al.
6,843,723 B2 1/2005 Joshi
6,884,170 B2 4/2005 Rowe
6,942,574 B1 9/2005 LeMay et al.
6,964,416 B2 11/2005 McClintic et al.
6,984,174 B2 1/2006 Cannon et al.
7,029,395 B1 4/2006 Baerlocher
7,070,505 B2 7/2006 Vancura et al.
7,156,741 B2 1/2007 Hornik et al.
7,217,189 B2 5/2007 Kaminkow
7,223,172 B2 5/2007 Baerlocher et al.
7,229,354 B2 6/2007 McNutt et al.
7,235,011 B2 6/2007 Randall et al.
7,241,221 B1 7/2007 Luciano, Jr. et al.
7,264,545 B2 9/2007 Maya et al.
7,413,508 B2 8/2008 Nelson et al.
7,419,429 B2 9/2008 Taylor
7,481,430 B1 1/2009 Jackson et al.
7,494,411 B2 2/2009 Baerlocher
7,503,849 B2 3/2009 Hornik et al.
7,563,163 B2 7/2009 Crumby
7,654,897 B2 2/2010 Devaull et al.
7,722,451 B2 5/2010 Hughs-Baird et al.
7,722,453 B2 5/2010 Lark et al.
7,785,189 B2 8/2010 Brosnan et al.
7,789,755 B2 9/2010 Davis et al.
7,811,168 B2 10/2010 Parham et al.
7,862,430 B2 1/2011 Baerlocher et al.
7,918,738 B2 4/2011 Paulsen
7,993,191 B2 8/2011 Evans et al.
8,002,620 B2 8/2011 Nicely et al.
8,092,299 B2 1/2012 Cohen et al.
8,147,320 B2 4/2012 Englman et al.
2001/0036858 A1 11/2001 McNutt et al.
2001/0055990 A1 12/2001 Acres
2002/0065123 A1 5/2002 Packes, Jr. et al.
2002/0142825 A1 10/2002 Lark et al.
2002/0142846 A1 10/2002 Paulsen
2002/0151366 A1 10/2002 Walker et al.
2002/0155874 A1 10/2002 Byrne
2003/0040355 A1 2/2003 Baerlocher
2003/0060266 A1 3/2003 Baerlocher
2003/0083943 A1 5/2003 Adams et al.
2003/0100361 A1 5/2003 Sharpless et al.
2003/0144057 A1 7/2003 Brenner et al.
2003/0148808 A1 8/2003 Price
2003/0171149 A1 9/2003 Rothschild
2003/0176220 A1 9/2003 Baerlocher
2003/0220135 A1 11/2003 Gauselmann
2003/0232640 A1 12/2003 Walker et al.
2004/0005919 A1 1/2004 Walker et al.
2004/0018866 A1 1/2004 Inoue
2004/0048649 A1 3/2004 Peterson et al.
2004/0048657 A1 3/2004 Gauselmann
2004/0058727 A1 3/2004 Marks et al.
2004/0063492 A1 4/2004 Baerlocher et al.
2004/0087370 A1 5/2004 Tarantino
2004/0139318 A1 7/2004 Fiala et al.
2004/0147306 A1 7/2004 Randall et al.
2004/0147314 A1 7/2004 LeMay et al.
2004/0185931 A1 9/2004 Lowell et al.
2004/0192432 A1 9/2004 Walker et al.
2004/0242324 A9 12/2004 Walker et al.
2005/0003883 A1 1/2005 Muir et al.
2005/0037843 A1 2/2005 Wells et al.
2005/0050571 A1 3/2005 Wisnudel et al.
2005/0054429 A1 3/2005 Baerlocher et al.

(56) References Cited

U.S. PATENT DOCUMENTS

2005/0059458 A1 3/2005 Griswold et al.
2005/0060050 A1 3/2005 Baerlocher
2005/0101375 A1 5/2005 Webb et al.
2005/0113163 A1 5/2005 Mattice et al.
2005/0143176 A1 6/2005 Cole
2005/0170890 A1 8/2005 Rowe et al.
2005/0255924 A1 11/2005 Cole
2006/0025193 A1 2/2006 Gail et al.
2006/0030412 A1 2/2006 Cole
2006/0040725 A1 2/2006 Walker et al.
2006/0040730 A1 2/2006 Walker et al.
2006/0046836 A1 3/2006 Walker et al.
2006/0068883 A1 3/2006 Randall et al.
2006/0068903 A1 3/2006 Walker et al.
2006/0079321 A1 4/2006 Walker et al.
2006/0084497 A1 4/2006 Marks et al.
2006/0089191 A1 4/2006 Singer et al.
2006/0095331 A1 5/2006 O'Malley et al.
2006/0111175 A1 5/2006 Walker et al.
2006/0121969 A1 6/2006 Marks et al.
2006/0128457 A1 6/2006 Cannon
2006/0142077 A1* 6/2006 Miles et al. ..... 463/20
2006/0154723 A1 7/2006 Saffari et al.
2006/0157928 A1 7/2006 O'Halloran
2006/0166740 A1 7/2006 Sufuentes
2006/0178205 A1 8/2006 Bleich et al.
2006/0183535 A1 8/2006 Marks et al.
2006/0189387 A1 8/2006 Rigsby et al.
2006/0194633 A1 8/2006 Paulsen
2006/0199640 A1 9/2006 Emori et al.
2006/0211484 A1 9/2006 Hornik et al.
2006/0211489 A1 9/2006 Walker et al.
2006/0223615 A1 10/2006 Englman
2006/0229124 A1* 10/2006 Walker et al. ..... 463/20
2006/0252516 A1 11/2006 Walker et al.
2006/0279044 A1 12/2006 Pacey
2006/0287090 A1 12/2006 Ocampo
2006/0290530 A1 12/2006 Ivancic
2007/0026923 A1 2/2007 Muir
2007/0054726 A1 3/2007 Muir et al.
2007/0060255 A1 3/2007 Baerlocher et al.
2007/0060321 A1 3/2007 Vasquez et al.
2007/0072678 A1 3/2007 Dagres
2007/0077984 A1 4/2007 Aida et al.
2007/0155490 A1 7/2007 Phillips et al.
2007/0167201 A1 7/2007 Schultz
2007/0184891 A1 8/2007 Thomas
2007/0191087 A1 8/2007 Thomas
2007/0203971 A1 8/2007 Walker et al.
2007/0265061 A1 11/2007 Marks et al.
2007/0270208 A1 11/2007 Caspers et al.
2007/0282678 A1 12/2007 Dendi et al.
2008/0020845 A1 1/2008 Low et al.
2008/0032787 A1 2/2008 Low et al.
2008/0076534 A1 3/2008 Iddings et al.
2008/0076548 A1 3/2008 Paulsen
2008/0090643 A1 4/2008 Kaminkow et al.
2008/0108423 A1 5/2008 Benbrahim et al.
2008/0113770 A1 5/2008 Gelber et al.
2008/0146326 A1 6/2008 Morrow et al.
2008/0153564 A1 6/2008 Baerlocher et al.
2008/0167954 A1 7/2008 Kawakami
2008/0182650 A1 7/2008 Randall et al.
2008/0224822 A1 9/2008 Gelman et al.
2008/0248867 A1 10/2008 Englman et al.
2009/0291736 A1 11/2009 Walker et al.
2009/0305776 A1 12/2009 Englman et al.
2010/0048283 A1 2/2010 Anderson et al.
2010/0062841 A1 3/2010 Englman et al.
2010/0075746 A1 3/2010 Anderson et al.
2010/0081497 A1 4/2010 Wolf et al.
2010/0113122 A1 5/2010 Walker et al.
2010/0120498 A1 5/2010 Cuddy et al.
2010/0120499 A1 5/2010 Cohen
2010/0120503 A1 5/2010 Hoffman et al.
2010/0120525 A1 5/2010 Baerlocher et al.
2010/0124971 A1 5/2010 Baerlocher et al.
2010/0124973 A1 5/2010 DeWaal et al.
2010/0137056 A1 6/2010 Hoffman et al.
2010/0210344 A1 8/2010 Edidin et al.
2011/0003627 A1 1/2011 Nicely et al.
2011/0045892 A1 2/2011 Vann et al.
2011/0059790 A1 3/2011 Slomiany et al.
2011/0105216 A1* 5/2011 Cohen et al. ..... 463/20
2011/0111826 A1 5/2011 Baerlocher et al.
2011/0117989 A1 5/2011 Kennedy et al.
2011/0118010 A1 5/2011 Brune
2011/0124402 A1 5/2011 De Waal et al.
2011/0201403 A1 8/2011 Jaffe et al.
2011/0201416 A1 8/2011 Jaffe
2011/0263312 A1 10/2011 De Waal et al.
2012/0214580 A1 8/2012 Hoffman et al.
2013/0178260 A1* 7/2013 Baerlocher et al. ..... 463/7
2013/0316787 A1* 11/2013 Hughes et al. ..... 463/20

* cited by examiner

GAMING SYSTEM AND METHOD EMPLOYING A PLAYER-SELECTED FEATURE FOR A PLAY OF A GAME OR USING THE PLAYER-SELECTED FEATURE TO MODIFY ANOTHER FEATURE FOR A SUBSEQUENT PLAY OF THE GAME

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming systems that provide players awards in primary or base games are well known. These gaming systems generally require a player to place a wager to activate a play of the primary game. For many of these gaming systems, any award provided to a player for a wagered-on play of a primary game is based on the player obtaining a winning symbol or a winning symbol combination and on an amount of the wager (e.g., the higher the amount of the wager, the higher the award). Winning symbols or winning symbol combinations that are less likely to occur typically result in higher awards being provided when they do occur.

For such known gaming systems, an amount of a wager placed on a primary game by a player may vary. For instance, a gaming system may enable a player to wager a minimum quantity of credits, such as one credit (e.g., in monetary currency, one penny, nickel, dime, quarter, or dollar; in non-monetary currency, one point, credit, coin, token, free play credit, or virtual buck), up to a maximum quantity of credits, such as five credits. The gaming system may enable the player to place this wager a single time or multiple times for a single play of the primary game. For instance, a gaming system configured to operate a slot game may have one or more paylines, and the gaming system may enable a player to place a wager on each of the paylines for a single play of the slot game. Thus, it is known that a gaming system, such as one configured to operate a slot game, may enable players to place wagers of substantially different amounts on each play of a primary game. For example, the amounts of the wagers may range from one credit up to 125 credits (e.g., five credits on each of twenty-five separate paylines). This is also true for other wagering games, such as video draw poker, in which players can place wagers of one or more credits on each hand, and in which multiple hands can be played simultaneously. Accordingly, it should be appreciated that different players play at substantially different wager amounts or levels and substantially different rates of play.

Bonus or secondary games are also known in gaming systems. Such gaming systems usually provide an award to a player for a play of one such bonus game in addition to any awards provided for any plays of any primary games. Bonus games usually do not require an additional wager to be placed by the player to be initiated. Bonus games are typically initiated or triggered upon an occurrence of a designated triggering symbol or designated triggering symbol combination in the primary game. For instance, a gaming system may initiate or trigger a bonus game when a bonus symbol occurs on the payline on the third reel of a three reel slot machine. The gaming systems generally indicates when a bonus game is initiated or triggered through one or more visual and/or audio output devices, such as the reels, lights, speakers, display screens, etc. Part of the enjoyment and excitement of playing certain gaming systems is the initiation or triggering of a bonus game, even before the player knows an amount of a bonus award won via the bonus game.

Certain known gaming systems provide predictable, non-interactive bonus opportunities, such as a play of a non-interactive bonus game or an outcome-enhancing feature, upon an occurrence of a triggering event. While initially enjoyable, the predictable, passive nature of such bonus opportunities becomes boring for certain players after a certain amount time.

A continuing need thus exists for gaming systems and methods that provide new, exciting, and engaging games that invite player interaction and exploration.

SUMMARY

Various embodiments of the present disclosure are directed to a gaming system and method providing a game employing a player-selected one of a plurality of different features or using the player-selected feature to modify another feature for a subsequent play of the game.

Generally, in certain embodiments, the gaming system is configured to operate a game associated with a set of a plurality of different features, and enables a player to select one of the features for a play of the game. In certain instances, the gaming system provides the play of the game in accordance with the selected feature. In other instances, the gaming system provides the play of the game without the selected feature, and uses the selected feature to modify one of the other, non-selected features that has a designated relationship with the selected feature. The gaming system subsequently enables the player to select the modified feature for a subsequent play of the game.

More specifically, in one example embodiment, the gaming system displays a set of a plurality of different components. Each of the displayed components is associated with one of a set of a plurality of different features, and each of one or more of the displayed components has a designated relationship with at least one of the other displayed components. The gaming system receives an indication associated with one of the displayed components for a first play of a game. The gaming system determines whether to provide the feature associated with the indicated component for the first play of the game. If the gaming system determines to provide the feature associated with the indicated component for the first play of the game, the gaming system displays the first play of the game in accordance with the feature associated with the indicated component. If, on the other hand, the gaming system determines not to provide the feature associated with the indicated component for the first play of the game, the gaming system displays the first play of the game without the feature associated with the indicated component. The gaming system determines one of the other displayed components with which the indicated component has the designated relationship. The gaming system modifies the feature associated with the determined component using the feature associated with the indicated component, and makes the modified feature available for a second subsequent play of the game.

Generally, in other embodiments, the gaming system is configured to operate a bonus round. Upon a player's initial entry into the bonus round, the gaming system provides a set of initially-locked features, and displays a partially-obscured representation of each locked feature such that some, but not all, of the information associated with each locked feature is apparent. Each time the player achieves entry into the bonus round, the gaming system enables the player to unlock one of the locked features (if any) by selecting one of the displayed partially-obscured representations of the locked features (if any). The gaming system unlocks the locked feature associated with the selected partially-obscured representation, and displays an unobscured representation of the unlocked feature. The gaming system provides each play of a game of the bonus round in accordance with at least one of the unlocked features.

More specifically, in one example embodiment, the gaming system initiates a first bonus round upon an occurrence of a bonus triggering event. For each of a set of a plurality of different locked features, the gaming system displays a partially-obscured representation of that locked feature. The gaming system receives a selection of a first one of the displayed partially-obscured representations associated with a locked first one of the features. The gaming system unlocks that locked first feature and displays an unobscured representation of the unlocked first feature. The gaming system displays a play of a game in accordance with the unlocked first feature. Upon another occurrence of the bonus triggering event, the gaming system initiates a second, subsequent bonus round. The gaming system displays the unobscured representation of the unlocked first feature. For each remaining locked feature, the gaming system displays the partially-obscured representation of that locked feature. The gaming system receives a selection of a second one of the displayed partially-obscured representations associated with a locked second one of the features. The gaming system unlocks the locked second feature and displays an unobscured representation of the unlocked second feature. The gaming system displays another play of the game in accordance with at least one of the unlocked first and second features.

It should thus be appreciated that the gaming system and method of the present disclosure provide new and different ways of enabling a player to interact with the gaming system and affect game play, thereby increasing player enjoyment, entertainment, and excitement.

Additional features and advantages are described herein, and will be apparent from, the following Detailed Description and the Figures.

DETAILED DESCRIPTION

Employing a Player-Selected Feature for a Play of a Game or Using the Player-Selected Feature to Modify Another Feature for a Subsequent Play of the Game Various embodiments of the present disclosure are directed to a gaming system and method providing a game employing a player-selected feature or using the player-selected feature to modify another feature for a subsequent play of the game. While the game of the present disclosure is employed as a primary game in the embodiments described below, it should be appreciated that the game may additionally or alternatively be employed as or in association with a bonus game or a secondary game. Moreover, while any credit balances, any wagers, and any awards are displayed as amounts of monetary credits or currency in the embodiments described below, one or more of such credit balances, such wagers, and such awards may be for non-monetary credits, promotional credits, and/or player tracking points or credits.

Figure 1:
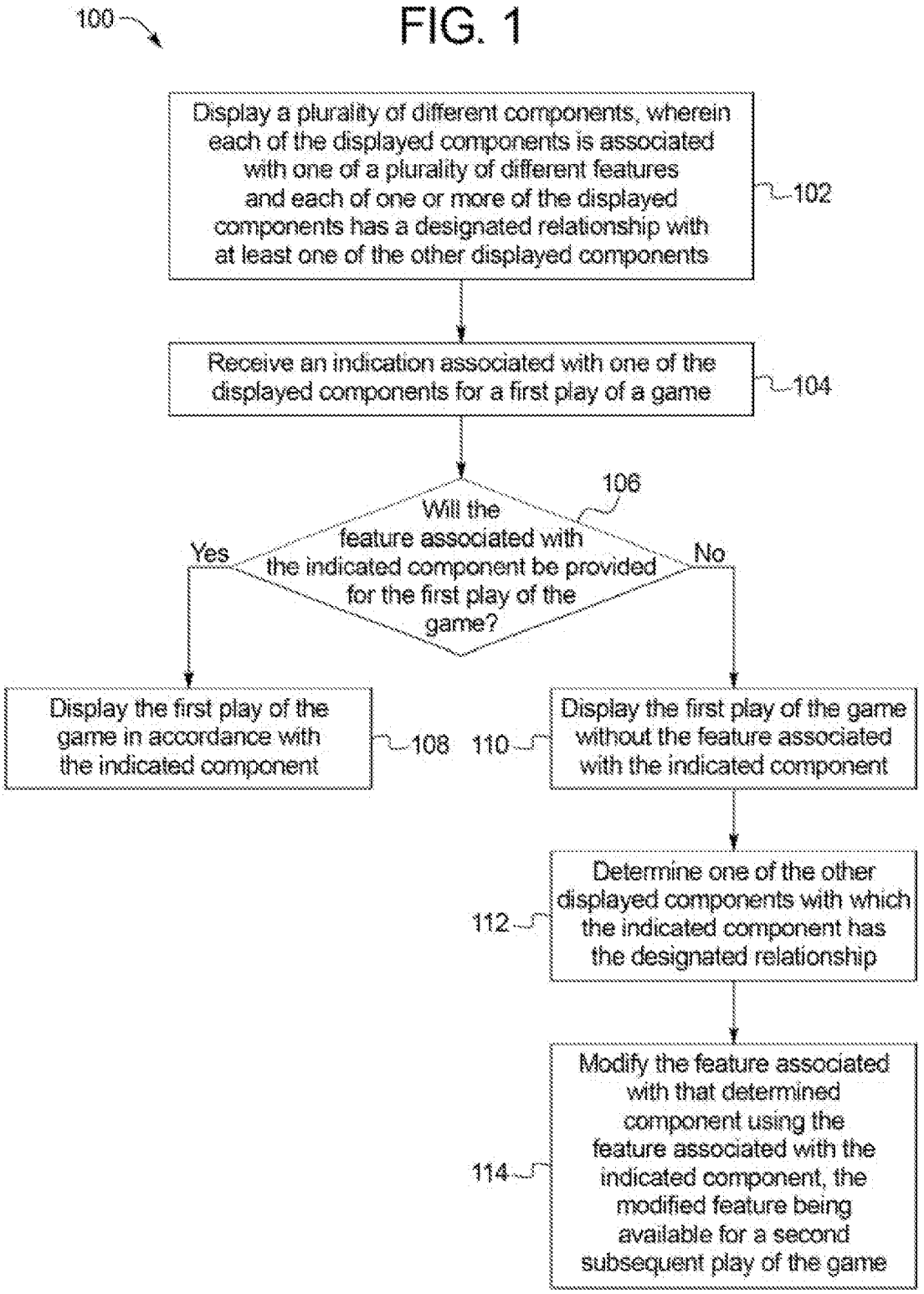
FIG. 1 is a flowchart illustrating a method of operating an example embodiment of the gaming system of the present disclosure that employs a player-selected feature for a play of a game or uses the player-selected feature to modify another feature for a subsequent play of the game.

FIG. 1 illustrates a flowchart of an example process or method 100 of operating the gaming system of the present disclosure. In various embodiments, process 100 is represented by a set of instructions stored in one or more memories and executed by one or more processors. Although process 100 is described with reference to the flowchart shown in FIG. 1, it should be appreciated that many other processes of performing the acts associated with this illustrated process 100 may be employed. For example, the order of certain of the illustrated blocks and/or diamonds may be changed, certain of the illustrated blocks and/or diamonds may be optional, and/or certain of the illustrated blocks and/or diamonds may not be employed.

In this example, the gaming system displays a set of a plurality of different components, as indicated by block 102. Each of the displayed components is associated with one of a set of a plurality of different features, and each of one or more of the displayed components has a designated relationship with at least one of the other displayed components. The gaming system receives an indication associated with one of the displayed components for a first play of a game, as indicated by block 104. The gaming system determines whether to provide the feature associated with the indicated component for the first play of the game, as indicated by diamond 106. If the gaming system determines to provide the feature associated with the indicated component for the first play of the game, the gaming system displays the first play of the game in accordance with the feature associated with the indicated component, as indicated by block 108.

If, on the other hand, the gaming system determines not to provide the feature associated with the indicated component for the first play of the game, the gaming system displays the first play of the game without the feature associated with the indicated component, as indicated by block 110. In this embodiment, the gaming system determines one of the other displayed components with which the indicated component has the designated relationship, as indicated by block 112. In this embodiment, the gaming system modifies the feature associated with the determined component using the feature associated with the indicated component, and makes the modified feature available for a second subsequent play of the game, as indicated by block 114.

FIGS. 2A, 2B, 2C, 2D, 2E, 2F, 2G, 2H, 2I, 2J, 2K, 2L, 2M, 2N, 2O, 2P, 2Q, and 2R illustrate screen shots of an example embodiment of the gaming system of the present disclosure providing plays of the game according to process 100 described above. In this example, the gaming system displays (such as on display device 2116 or 2118, described below) a plurality of reels including reels 205*a*, 205*b*, 205*c*, 205*d*, and 205*e*. The reels are associated with a plurality of different symbols. The gaming system displays the reels in association with a plurality of symbol display areas 210*a*, 210*b*, 210*c*, 210*d*, 210*e*, 210*f*, 210*g*, 210*h*, 210*i*, 210*j*, 210*k*, 210*l*, 210*m*, 210*n*, and 210*o* arranged in a 3×5 matrix such that: reel 205*a* is displayed in association with symbol display areas 210*a*, 210*f*, and 210*k*; reel 205*b* is displayed in association with symbol display areas 210*b*, 210*g*, and 210*l*; reel 205*c* is displayed in association with symbol display areas 210*c*, 210*h*, and 210*m*; reel 205*d* is displayed in association with symbol display areas 210*d*, 210*i*, and 210*n*; and reel 205*e* is displayed in association with symbol display areas 210*e*, 210*j*, and 210*o*. The gaming system displays a plurality of paylines, each of which is associated with a different plurality of the symbol display areas. In this example, payline 215*a* is associated with symbol display areas 210*a*, 210*b*, 210*c*, 210*d*, and 210*e*; payline 215*b* is associated with symbol display areas 210*f*, 210*g*, 210*h*, 210*i*, and 210*j*; and payline 215*c* is associated with symbol display areas 210*k*, 210*l*, 210*m*, 210*n*, and 210*o*.

The gaming system displays a set of a plurality of different components 300, 400, 500, and 600, each of which is associated with a feature of a set of different features. Component 300 is associated with a multiplier feature that, if employed for a play of the game, causes the gaming system to use a randomly selected multiplier (i.e., one of multipliers 2×, 3×, 4×, and 5× in this example) to modify any determined awards for the play of the game. Component 400 is associated with a symbol drop feature that, if employed for a play of the game, causes the gaming system to display a randomly selected symbol at a randomly selected number of symbol display areas for the play of the game. Component 500 is associated with an award increase feature that, if employed for a play of the game, causes the gaming system to increase a value of the award(s) associated with a randomly-selected symbol for the play of the game. Component 600 is associated with a symbol removal feature that, if employed for a play of the game, causes the gaming system to, after generating and displaying a plurality of symbols at the symbol display areas: (a) remove one of: (1) a randomly selected number of the displayed symbols, (2) the displayed symbols included in any displayed winning symbol combinations, and (3) any displayed instances of a designated symbol; (b) reposition one or more of the remaining displayed symbols into one or more of the empty symbol display areas (if any); and (c) thereafter, generate and display symbols at the empty symbol display areas (if any).

In this example, each of one or more of the components has a designated relationship with at least one of the other components. More specifically, in this example, component 300 has the designated relationship with component 400, component 500 has the designated relationship with component 400, and component 500 has the designated relationship with component 600. In this example, the designated relationships are one-way relationships. That is, in this example, component 400 does not have the designated relationship with component 300 (even though component 300 has the designated relationship with component 400), component 400 does not have the designated relationship with component 500 (even though component 500 has the designated relationship with component 400), and component 600 does not have the designated relationship with component 500 (even though component 500 has the designated relationship with component 600).

Each of the components 300, 400, 500, and 600 is associated with a separate spin button 350, 450, 550, and 650, respectively. For a play of the game, after placement of a wager, the gaming system enables a player to actuate or otherwise indicate one of the spin buttons 350, 450, 550, and 650 to select a feature and initiate a spin of the reels. Generally, when the gaming system receives an actuation of one of the spin buttons, the gaming system either: (a) provides the play of the game in accordance with the feature associated with the component associated with the actuated spin button, or (b) provides the play of the game without the feature associated with the component associated with the actuated spin button and uses that feature to modify the feature of one of the other components for a subsequent play of the game.

More specifically, for a play of the game in this example, when the gaming system receives an actuation of one of the spin buttons to initiate a spin of the reels, the gaming system determines whether the component associated with the actuated spin button has the designated relationship with any of the other components. If not, the gaming system provides the play of the game in accordance with the feature associated with the component associated with the actuated spin button. If, on the other hand, the component associated with the actuated spin button has the designated relationship with one or more of the other components, the gaming system randomly determines whether to provide the feature associated with that component for the play of the game. If the gaming system determines to provide the feature associated with that component for the play of the game, the gaming system provides the play of the game in accordance with the feature associated with that component. If not, the gaming system uses the feature associated with that component to modify the feature associated with one of the components with which the component associated with the actuated spin button has a designated relationship, and enables that modified feature to be selected in a subsequent play of the game.

In this example, the gaming system displays a random feature spin button 250. When the gaming system receives an actuation of the random feature spin button 250, the gaming system randomly selects one of the components and, as described above, either: (a) provides the play of the game in accordance with the feature associated with the selected component, or (b) provides the play of the game without the feature associated with the selected component and uses that feature to modify the feature of one of the other components for a subsequent play of the game. In another embodiment, when the gaming system receives an actuation of the spin button 250, the gaming system selects one of the components according to a predetermined order or sequence rather than a randomly determined feature.

The gaming system also displays a message box 260 that displays messages or indications before, during, or after play of the game, and a plurality of meters including: a wager meter 270 that displays any wager placed on a play of the game, an award meter 280 that displays any awards won during the play of the game, and a credit meter 290 that displays the player's credit balance. While in this illustrated example the gaming system indicates any awards in the form of amounts of credits, it should be appreciated that such indications may alternatively or additionally be made in the form of amounts of currency.

Figure 2A:
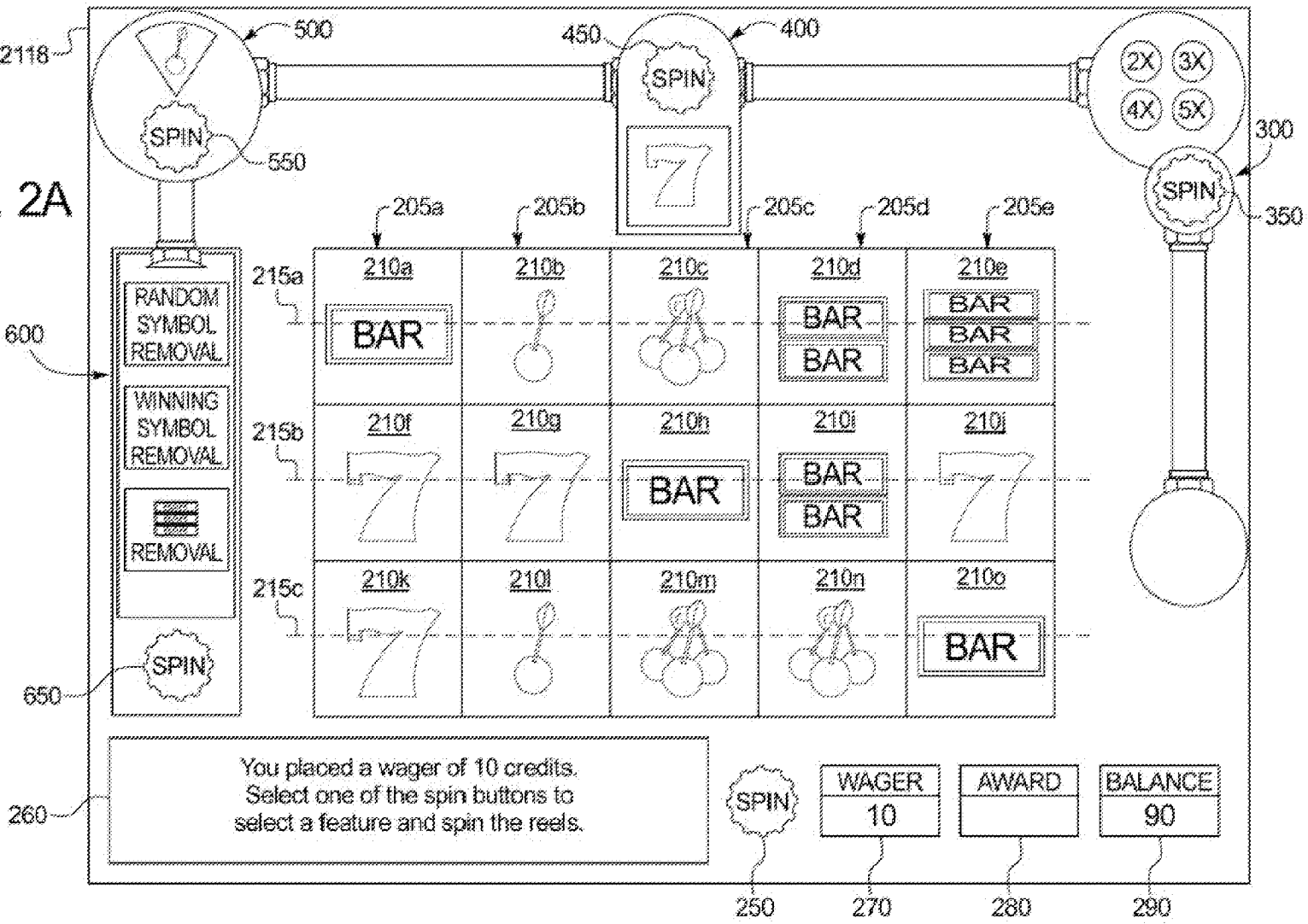
FIGS. 2A, 2B, 2C, 2D, 2E, 2F, 2G, 2H, 2I, 2J, 2K, 2L, 2M, 2N, 2O, 2P, 2Q, and 2R illustrate screen shots of an example embodiment of the gaming system of the present disclosure providing plays of the game of the present disclosure according to the method of FIG. 1.
Figure 2B:
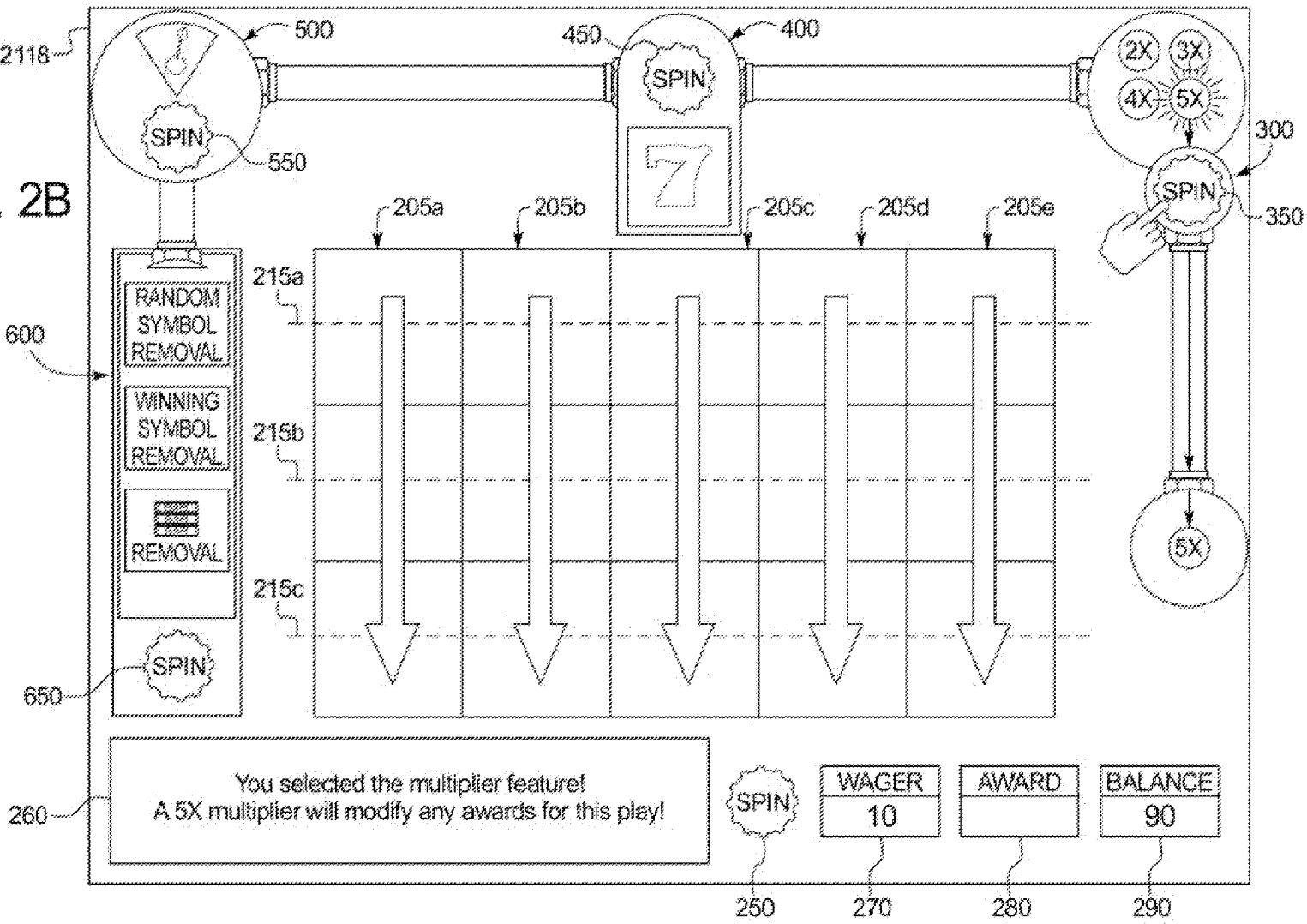

Turning to FIG. 2A, upon receiving a wager of 10 credits from a player for a play of the game (as indicated by wager meter 270), the gaming system enables the player to actuate one of spin buttons 250, 350, 450, 550, and 650 to initiate a spin of the reels and to select the feature associated with that actuated spin button (or to cause the gaming system to randomly select one of the features) for the play of the game. The gaming system displays the following message in message box 260: "YOU PLACED A WAGER OF 10 CREDITS. SELECT ONE OF THE SPIN BUTTONS TO SELECT A FEATURE AND SPIN THE REELS."

As illustrated in FIG. 28, the gaming system receives an actuation of spin button 350 associated with component 300 and the multiplier feature and displays the reels spinning. The gaming system: (a) determines that component 300 has the designated relationship with component 400, and (b) randomly determines to provide the play of the game in accordance with the multiplier feature associated with component 300 associated with the actuated spin button 350. Accordingly, the gaming system randomly selects the 5× multiplier, and displays the following message in message box 260: "YOU SELECTED THE MULTIPLIER FEATURE! A 5× MULTIPLIER WILL MODIFY ANY AWARDS FOR THIS PLAY!"

Figure 2C:
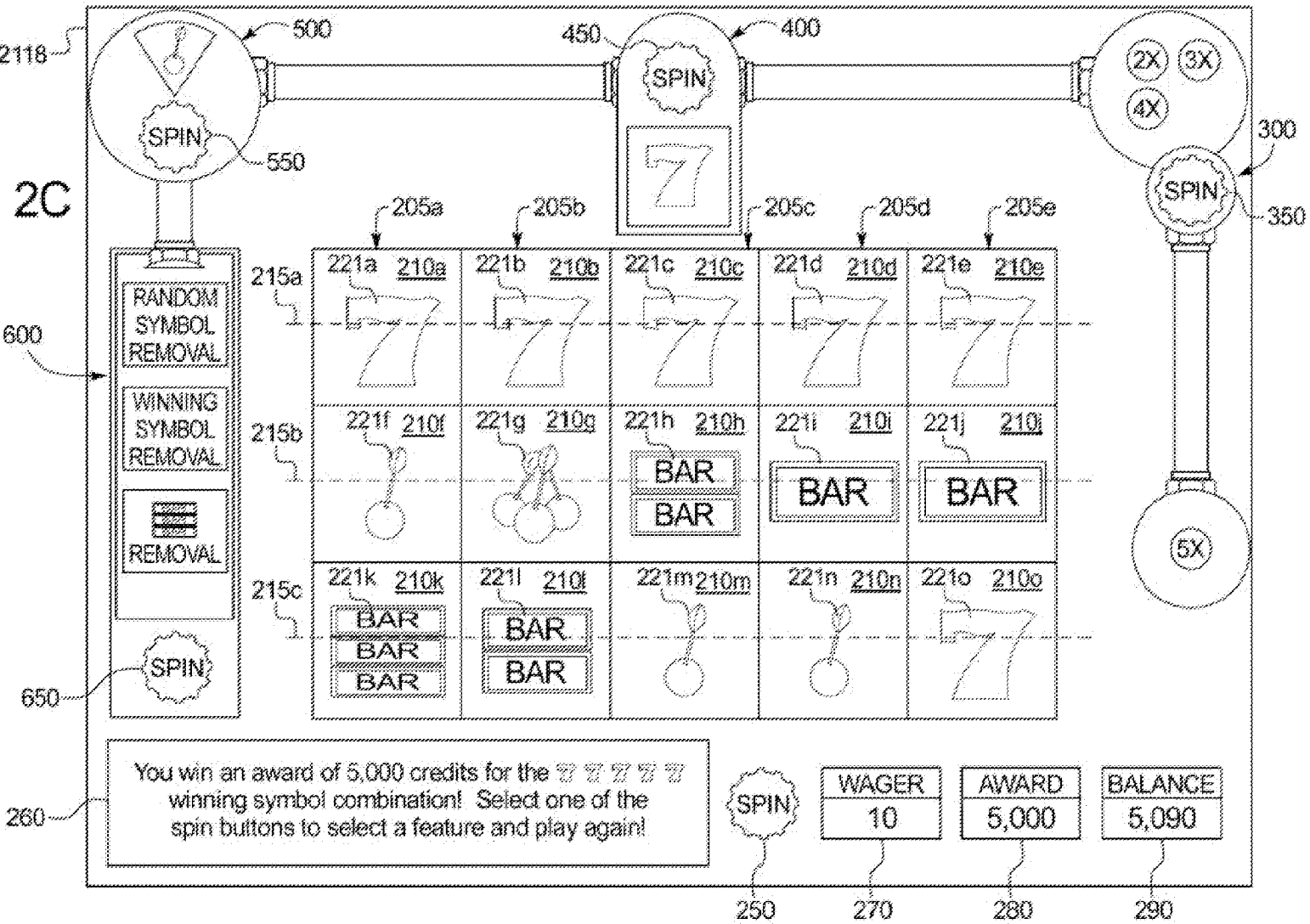

Turning to FIG. 2C, the gaming system stops the reels such that a plurality of the symbols are displayed at the symbol display areas. In this illustrated example, the gaming system displays: Seven symbol 221*a* at symbol display area 210*a*, Seven symbol 221*b* at symbol display area 210*b*, Seven symbol 221*c* at symbol display area 210*c*, Seven symbol 221*d* at symbol display area 210*d*, Seven symbol 221*e* at symbol display area 210*e*, Cherry symbol 221*f* at symbol display area 210*f*, Triple Cherry symbol 221*g* at symbol display area 210*g*, Double Bar symbol 221*h* at symbol display area 210*h*, Bar symbol 221*i* at symbol display area 210*i*, Bar symbol 221*j* at symbol display area 210*j*, Triple Bar symbol 221*k* at symbol display area 210*k*, Double Bar symbol 221*l* at symbol display area 210*l*, Cherry symbol 221*m* at symbol display area 210*m*, Cherry symbol 221*n* at symbol display area 210*n*, and Seven symbol 221*o* at symbol display area 210*o*.

The gaming system makes an award determination by determining (based on a paytable, which is not shown) whether the symbols displayed at the symbol display areas form any of a plurality of different winning symbol combinations along paylines 215*a*, 215*b*, and/or 215*c*. In this example, the gaming system determines an award of 1,000 credits associated with the Seven-Seven-Seven-Seven-Seven winning symbol combination displayed along payline 215*a*. The gaming system uses the 5× multiplier to modify the determined 1,000 credit award such that the total award for the play of the game is 5,000 credits. The gaming system updates award meter 280 and the player's credit balance displayed in credit meter 290 to reflect the 5,000 credit total award. The gaming system displays the following message in message box 260: "YOU WIN AN AWARD OF 5,000 CREDITS FOR THE 7 7 7 7 7 WINNING SYMBOL COMBINATION! SELECT ONE OF THE SPIN BUTTONS TO SELECT A FEATURE AND PLAY AGAIN!"

Figure 2D:
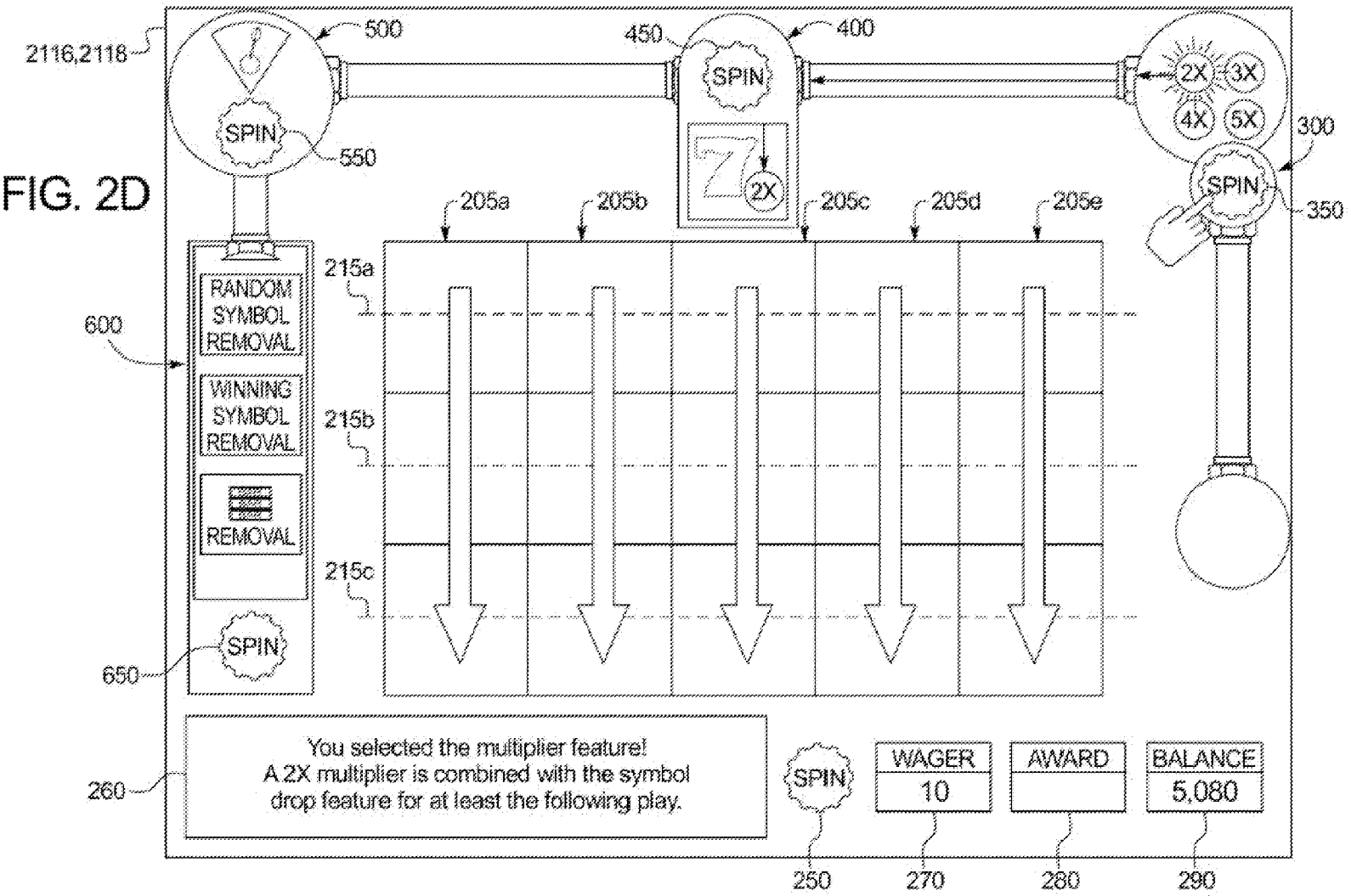

As illustrated in FIG. 2D, the gaming system receives another wager of 10 credits from the player for another play of the game; enables the player to actuate one of spin buttons 250, 350, 450, 550, and 650 to initiate a spin of the reels and to select the feature associated with that actuated spin button (or to cause the gaming system to randomly select one of the features) for the play of the game; receives an actuation of spin button 350 associated with component 300 and the multiplier feature; and displays the reels spinning. The gaming system: (a) determines that component 300 has the designated relationship with component 400, and (b) randomly determines to provide the play of the game without the multiplier feature associated with component 300 associated with the actuated spin button 350 and to use the multiplier feature to modify the symbol drop feature associated with component 400. Accordingly, the gaming system randomly selects the 2× multiplier and displays the 2× multiplier in association with the symbol drop feature of component 400 to create a modified symbol drop feature for at least one subsequent play of the game (as described below). The gaming system displays the following message in message box 260: "YOU SELECTED THE MULTIPLIER FEATURE! A 2× MULTIPLIER IS COMBINED WITH THE SYMBOL DROP FEATURE FOR AT LEAST THE FOLLOWING PLAY!"

Figure 2E:
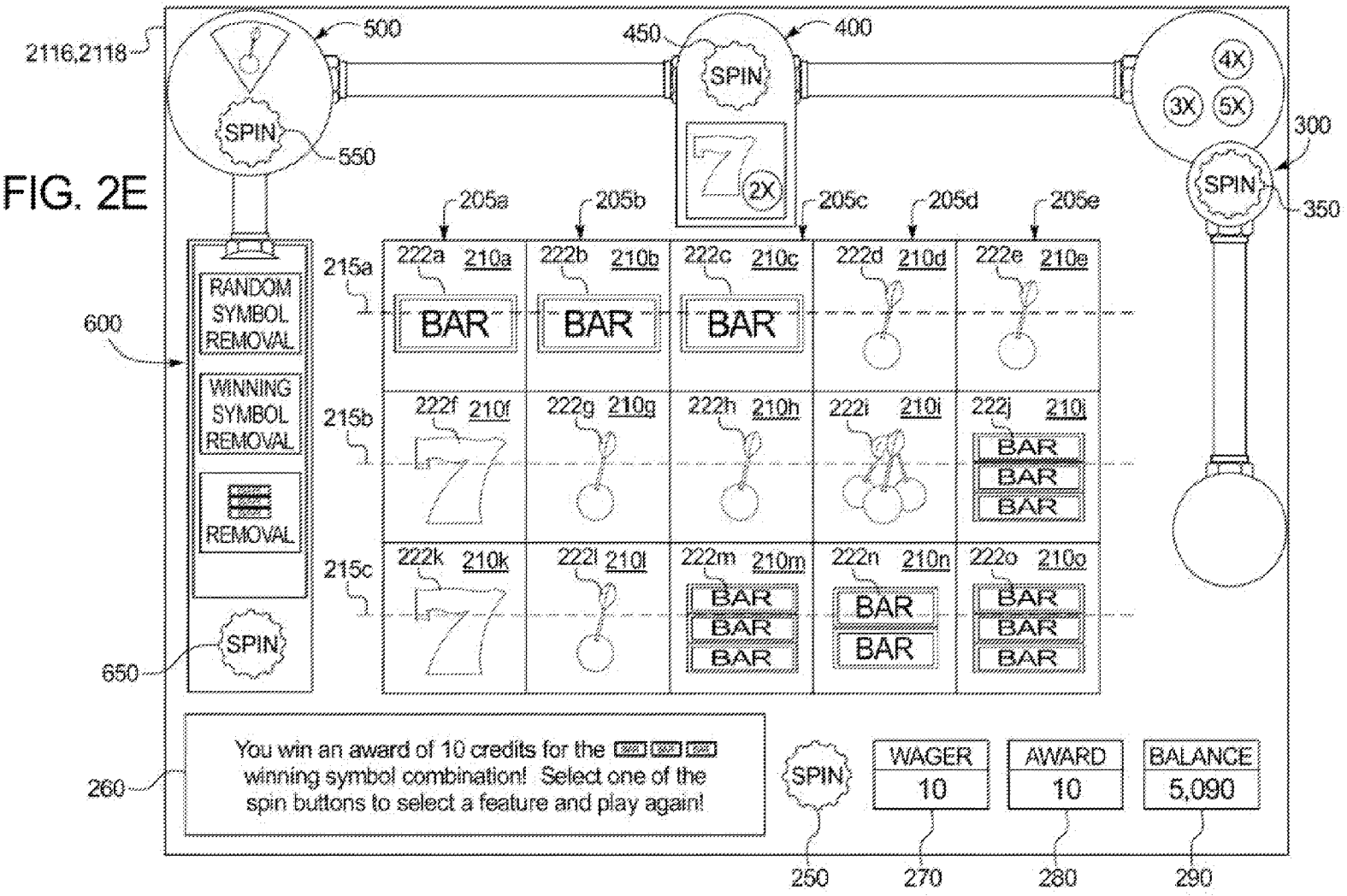

Turning to FIG. 2E, the gaming system stops the reels such that a plurality of the symbols are displayed at the symbol display areas. In this illustrated example, the gaming system displays: Bar symbol 222*a* at symbol display area 210*a*, Bar symbol 222*b* at symbol display area 210*b*, Bar symbol 222*c* at symbol display area 210*c*, Cherry symbol 222*d* at symbol display area 210*d*, Cherry symbol 222*e* at symbol display area 210*e*, Bar symbol 222*f* at symbol display area 210*f*, Cherry symbol 222*g* at symbol display area 210*g*, Cherry symbol 222*h* at symbol display area 210*h*, Triple Cherry symbol 222*i* at symbol display area 210*i*, Triple Bar symbol 222*j* at symbol display area 210*j*, Seven symbol 222*k* at symbol display area 210*k*, Cherry symbol 222*l* at symbol display area 210*l*, Triple Bar symbol 222*m* at symbol display area 210*m*, Triple Bar symbol 222*n* at symbol display area 210*n*, and Triple Bar symbol 222*o* at symbol display area 210*o*.

The gaming system makes an award determination by determining (based on the paytable, which is not shown) whether the symbols displayed at the symbol display areas form any of the winning symbol combinations along paylines 215*a*, 215*b*, and/or 215*c*. In this example, the gaming system determines an award of 10 credits associated with the Bar-Bar-Bar winning symbol combination displayed along payline 215*a*. The gaming system updates award meter 280 and the player's credit balance displayed in credit meter 290 to reflect the 10 credit award. The gaming system displays the following message in message box 260: "YOU WIN AN AWARD OF 10 CREDITS FOR THE BAR BAR BAR WINNING SYMBOL COMBINATION!SELECT ONE OF THE SPIN BUTTONS TO SELECT A FEATURE AND PLAY AGAIN!"

Figure 2F:
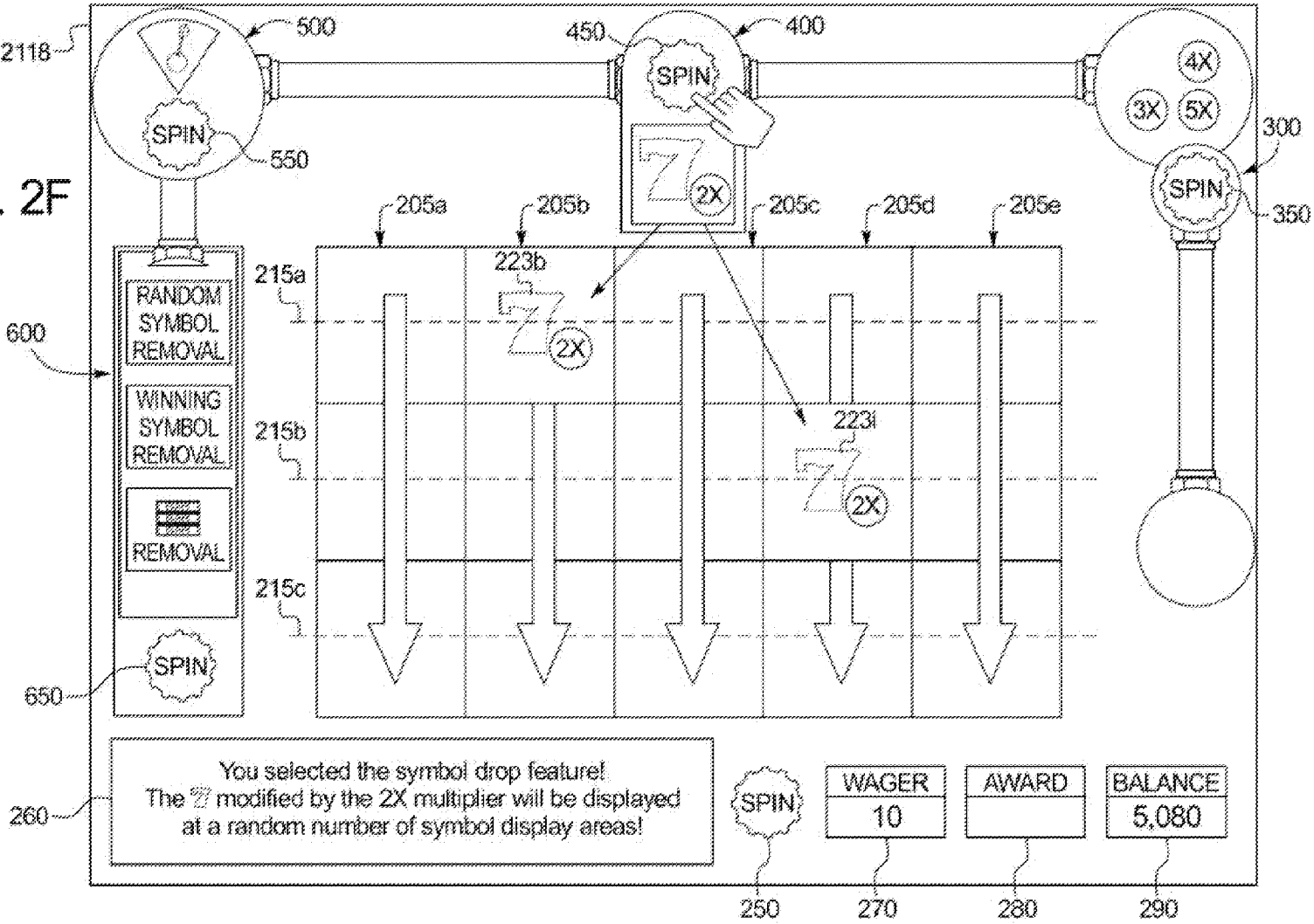

As illustrated in FIG. 2F, the gaming system receives another wager of 10 credits from the player for another play of the game; enables the player to actuate one of spin buttons 250, 350, 450, 550, and 650 to initiate a spin of the reels and to select the feature associated with that actuated spin button (or to cause the gaming system to randomly select one of the features) for the play of the game; receives an actuation of spin button 450 associated with component 400 and the modified symbol drop feature; and displays the reels spinning. In this example, the modified symbol drop feature is associated with the Seven symbol and the 2× multiplier. The gaming system: (a) determines that component 400 does not have the designated relationship with any of the other components, and (b) provides the play of the game in accordance with the modified symbol drop feature associated with component 400 associated with the actuated spin button 450. Accordingly, the gaming system randomly selects symbol display areas 210*b* and 210*i* and displays instances 223*b* and 223*i* of the 2× Seven symbol at symbol display areas 210*b* and 210*i*, respectively. The gaming system displays the following message in message box 260: "YOU SELECTED THE SYMBOL DROP FEATURE THE 7 MODIFIED BY THE 2× MULTIPLIER WILL BE DISPLAYED AT A RANDOM NUMBER OF SYMBOL DISPLAY AREAS!"

Figure 2G:
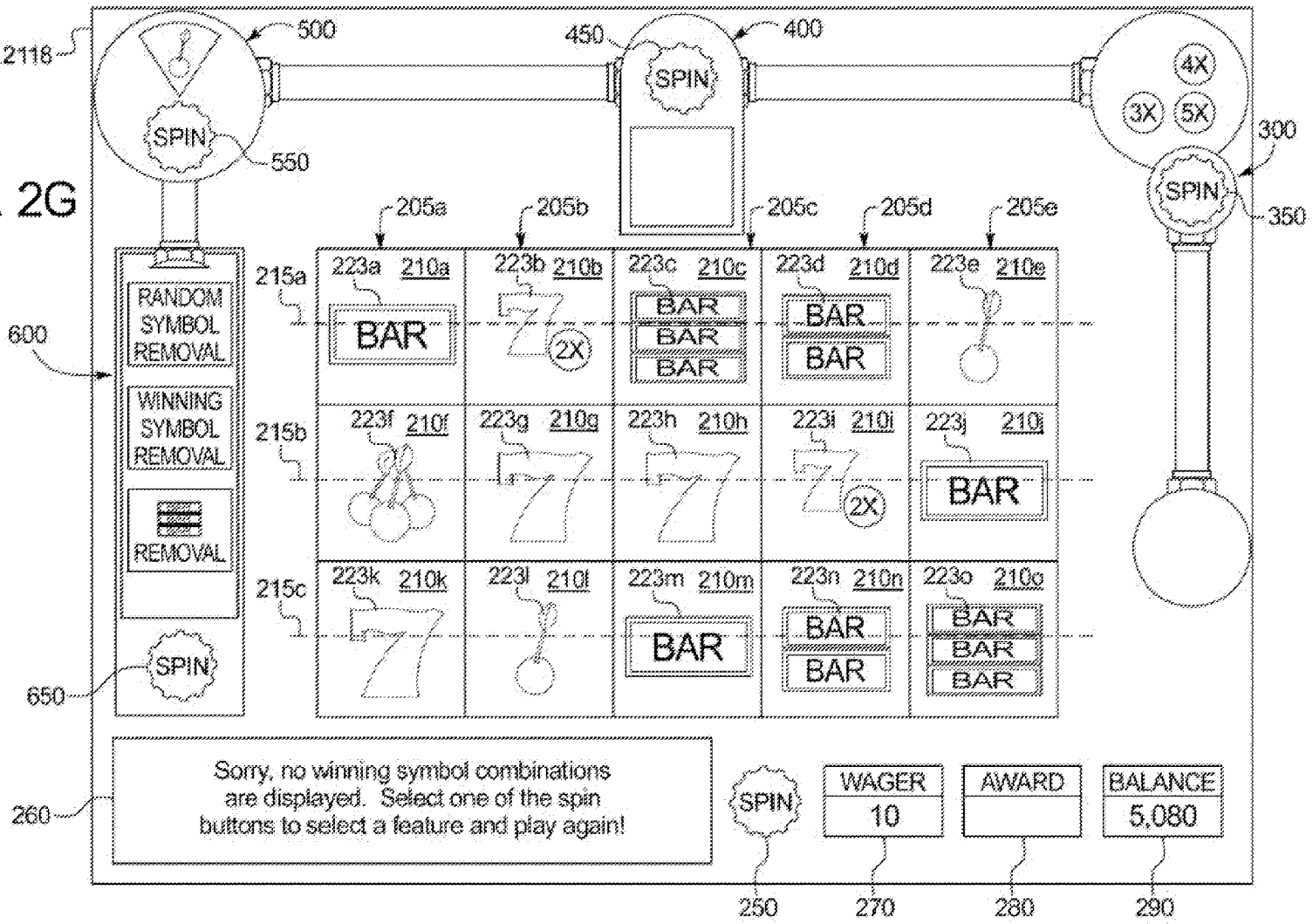

Turning to FIG. 2G, the gaming system stops the reels such that a plurality of the symbols are displayed at the remaining symbol display areas. In this illustrated example, the gaming system displays: Bar symbol 223*a* at symbol display area 210*a*, Triple Bar symbol 223*c* at symbol display area 210*c*, Triple Bar symbol 223*d* at symbol display area 210*d*, Cherry symbol 223*e* at symbol display area 210*e*, Triple Cherry symbol 223*f* at symbol display area 210*f*, Seven symbol 223*g* at symbol display area 210*g*, Seven symbol 223*h* at symbol display area 210*h*, Bar symbol 223*j* at symbol display area 210*j*, Seven symbol 223*k* at symbol display area 210*k*, Cherry symbol 223*l* at symbol display area 210*l*, Bar symbol 223*m* at symbol display area 210*m*, Double Bar symbol 223*n* at symbol display area 210*n*, and Triple Bar symbol 223*o* at symbol display area 210*o*. The gaming system also randomly determines the Cherry symbol and displays the Cherry symbol in association with the symbol drop feature.

The gaming system makes an award determination by determining (based on the paytable, which is not shown) whether the symbols displayed at the symbol display areas form any of the winning symbol combinations along paylines 215*a*. 215*b*, and/or 215*c*. In this example, the gaming system determines that none of the winning symbol combinations are displayed. The gaming system displays the following message in message box 260: "SORRY, NO WINNING SYMBOL COMBINATIONS ARE DISPLAYED. SELECT ONE OF THE SPIN BUTTONS TO SELECT A FEATURE AND PLAY AGAIN!"

Figure 2H:
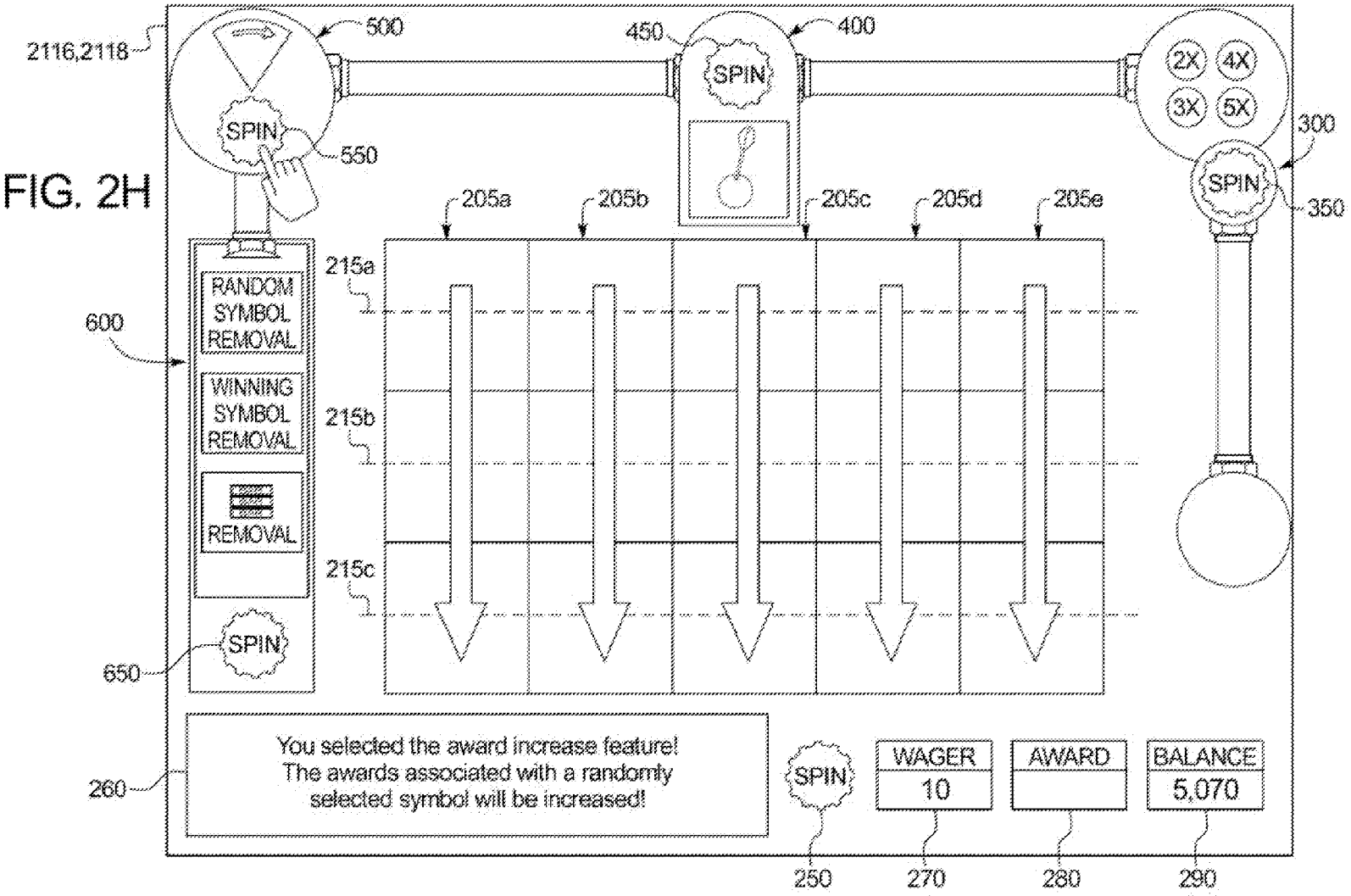

As illustrated in FIG. 2H, the gaming system receives another wager of 10 credits from the player for another play of the game; enables the player to actuate one of spin buttons 250, 350, 450, 550, and 650 to initiate a spin of the reels and to select the feature associated with that actuated spin button (or to cause the gaming system to randomly select one of the features) for the play of the game; receives an actuation of spin button 550 associated with component 500 and the award increase feature; and displays the reels spinning. The gaming system: (a) determines that component 500 has the designated relationship with component 400 and with component 600, and (b) randomly determines to provide the play of the game in accordance with the award increase feature associated with component 500 associated with the actuated spin button 550. The gaming system displays the following message in message box 260: "YOU SELECTED THE AWARD INCREASE FEATURE! THE AWARDS ASSOCIATED WITH A RANDOMLY SELECTED SYMBOL WILL BE INCREASED!"

Figure 2I:
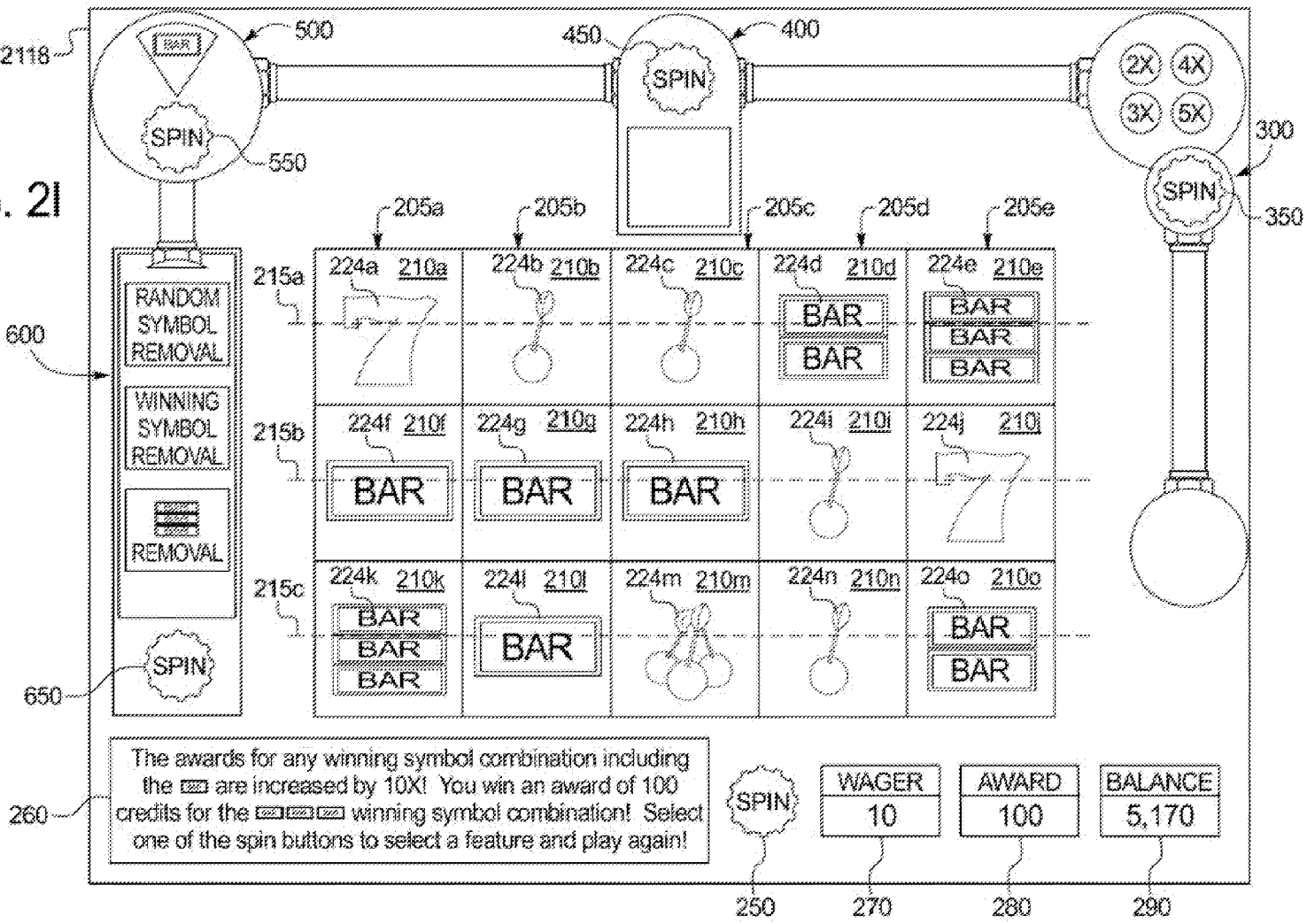

In this example, the award increase feature causes the gaming system to increase any awards associated with any winning symbol combinations including a randomly determined symbol by 10×. Turning to FIG. 2I, the gaming system randomly determines the Bar symbol in association with the award increase feature and displays the randomly determined Bar symbol in association with component 500. Thus, the gaming system increases any awards associated with any winning symbol combinations including the Bar symbol by 10×. The gaming system stops the reels such that a plurality of the symbols are displayed at the symbol display areas. In this illustrated example, the gaming system displays: Seven symbol 224*a* at symbol display area 210*a*, Cherry symbol 224*b* at symbol display area 210*b*, Cherry symbol 224*c* at symbol display area 210*c*, Double Bar symbol 224*d* at symbol display area 210*d*, Triple Bar symbol 224*e* at symbol display area 210*e*, Bar symbol 224*f* at symbol display area 210*f*, Bar symbol 2249 at symbol display area 210*g*, Bar symbol 224*h* at symbol display area 210*h*, Cherry symbol 224*i* at symbol display area 210*i*, Seven symbol 224*j* at symbol display area 210*j*, Triple Bar symbol 224*k* at symbol display area 210*k*, Bar symbol 224*l* at symbol display area 210*l*, Triple Cherry symbol 224*m* at symbol display area 210*m*, Cherry symbol 224*n* at symbol display area 210*n*, and Double Bar symbol 224*o* at symbol display area 210*o*.

The gaming system makes an award determination by determining (based on the paytable, which is not shown) whether the symbols displayed at the symbol display areas form any of the winning symbol combinations along paylines 215*a*. 215*b*, and/or 215*c*. In this example, the gaming system determines an award of 10 credits associated with the Bar-Bar-Bar winning symbol combination displayed along payline 215*b*. Since the winning symbol combination includes the Bar symbol, the gaming system uses the 10× multiplier to modify the determined 10 credit award such that the total award for the play of the game is 100 credits. The gaming system updates award meter 280 and the player's credit balance displayed in credit meter 290 to reflect the 100 credit award. The gaming system displays the following message in message box 260: "THE AWARDS FOR ANY WINNING SYMBOL COMBINATIONS INCLUDING THE BAR ARE INCREASED BY 10×! YOU WIN AN AWARD OF 100 CREDITS FOR THE BAR BAR BAR WINNING SYMBOL COMBINATION! SELECT ONE OF THE SPIN BUTTONS TO SELECT A FEATURE AND PLAY AGAIN!"

Figure 2J:
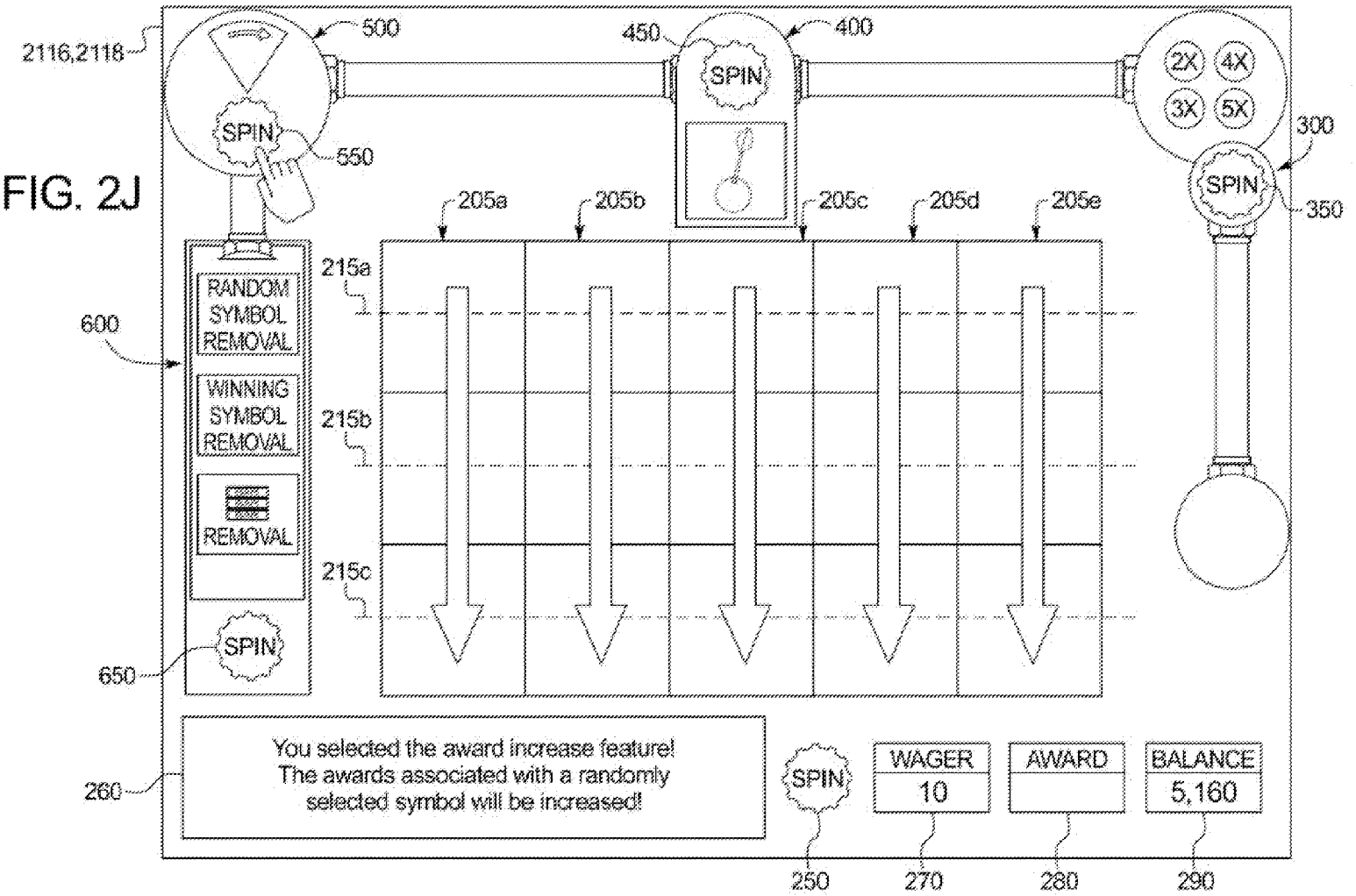

As illustrated in FIG. 2J, the gaming system receives another wager of 10 credits from the player for another play of the game; enables the player to actuate one of spin buttons 250, 350, 450, 550, and 650 to initiate a spin of the reels and to select the feature associated with that actuated spin button (or to cause the gaming system to randomly select one of the features) for the play of the game; receives an actuation of spin button 550 associated with component 500 and the award increase feature; and displays the reels spinning. The gaming system: (a) determines that component 500 has a designated relationship with component 400 and with component 600, and (b) randomly determines to provide the play of the game without the award increase feature associated with component 500 associated with the actuated spin button 550 and to use the award increase feature to modify the symbol drop feature associated with component 400. The gaming system displays the following message in message box 260: "YOU SELECTED THE AWARD INCREASE FEATURE! THE AWARDS ASSOCIATED WITH A RANDOMLY SELECTED SYMBOL WILL BE INCREASED!"

Figure 2K:
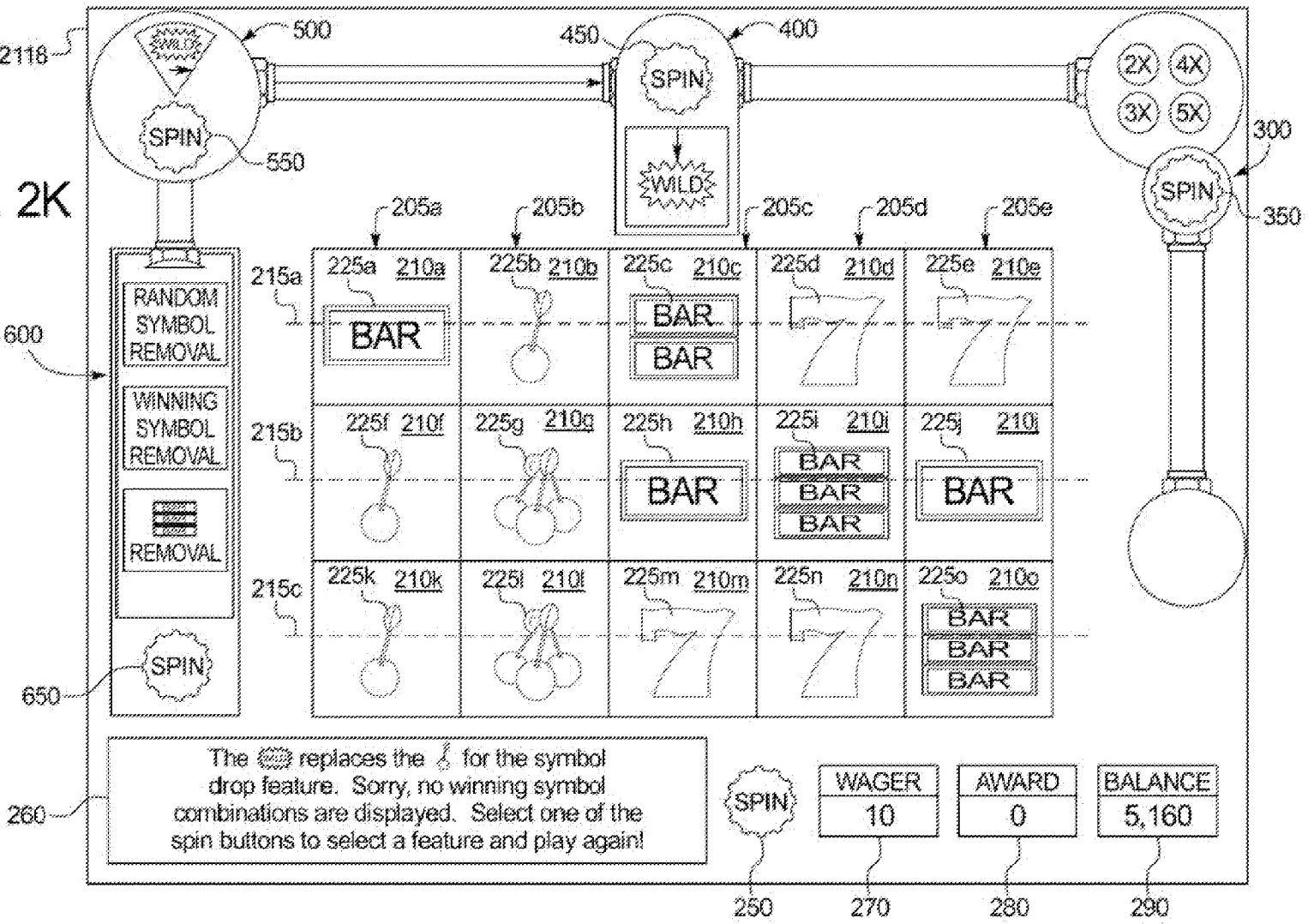

Turning to FIG. 2K, the gaming system randomly determines the Wild symbol in association with the award increase feature and displays the randomly determined Wild symbol in association with component 500. The gaming system modifies the symbol drop feature by replacing the Cherry symbol associated with the symbol drop feature with the randomly determined Wild symbol. The modified symbol drop feature is available for at least one subsequent play of the game. The gaming system stops the reels such that a plurality of the symbols are displayed at the symbol display areas. In this illustrated example, the gaming system displays: Bar symbol 225*a* at symbol display area 210*a*, Cherry symbol 225*b* at symbol display area 210*b*, Double Bar symbol 225*c* at symbol display area 210*c*, Seven symbol 225*d* at symbol display area 210*d*, Seven symbol 225*e* at symbol display area 210*e*, Cherry symbol 225*f* at symbol display area 210*f*, Triple Cherry symbol 225*g* at symbol display area 210*g*, Bar symbol 225*h* at symbol display area 210*h*, Triple Bar symbol 225*i* at symbol display area 210*i*, Bar symbol 225*j* at symbol display area 210*j*, Cherry symbol 225*k* at symbol display area 210*k*, Triple Cherry symbol 225*l* at symbol display area 210*l*, Seven symbol 225*m* at symbol display area 210*m*, Seven symbol 225*n* at symbol display area 210*n*, and Triple Bar symbol 225*o* at symbol display area 210*o*.

The gaming system makes an award determination by determining (based on the paytable, which is not shown) whether the symbols displayed at the symbol display areas form any of the winning symbol combinations along paylines 215*a*, 215*b*, and/or 215*c*. In this example, the gaming system determines that none of the winning symbol combinations are displayed. The gaming system displays the following message in message box 260: "THE WILD REPLACES THE CHERRY FOR THE SYMBOL DROP FEATURE! SORRY, NO WINNING SYMBOL COMBINATIONS ARE DISPLAYED. SELECT ONE OF THE SPIN BUTTONS TO SELECT A FEATURE AND PLAY AGAIN!"

Figure 2L:
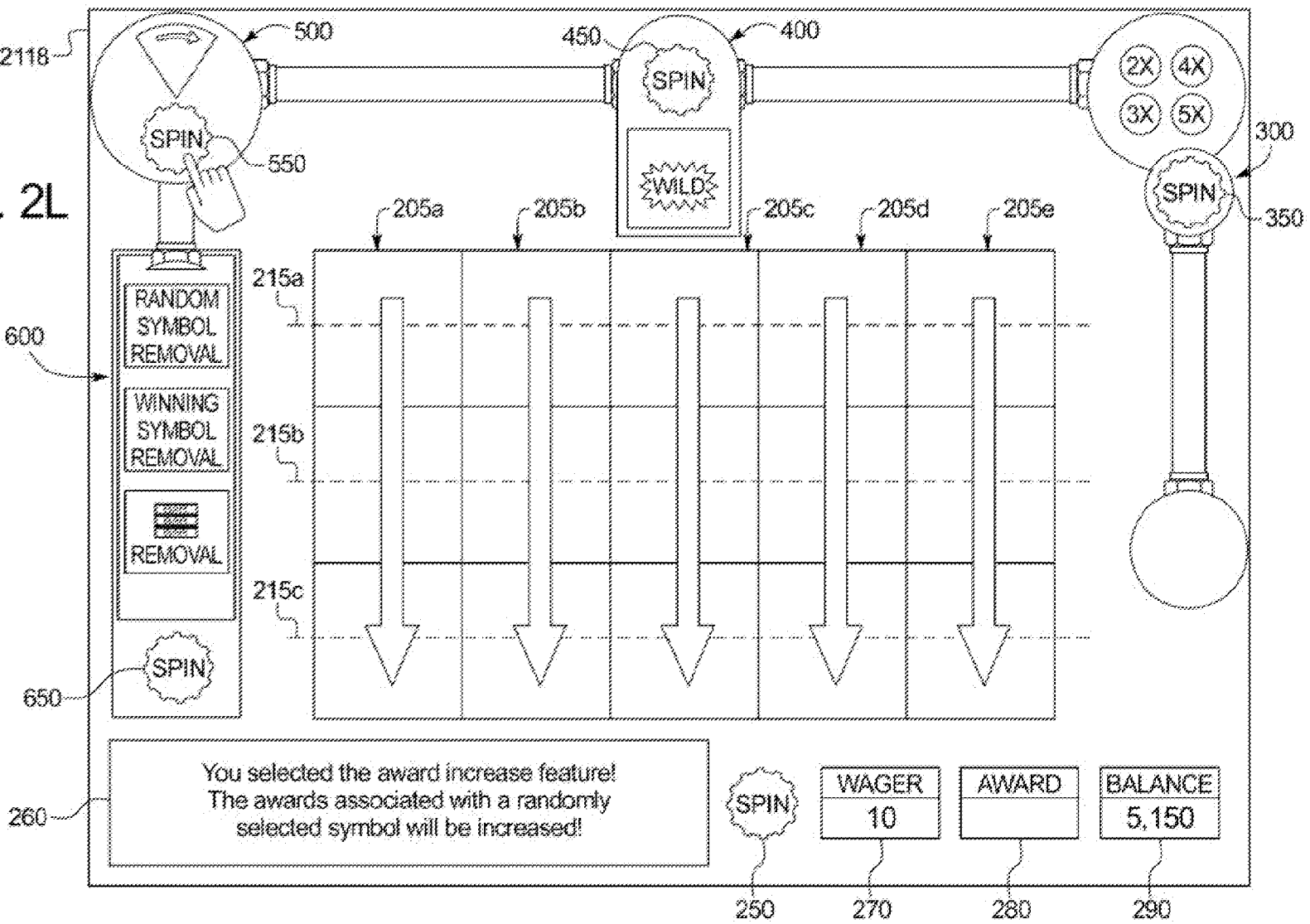

As illustrated in FIG. 2L, the gaming system receives another wager of 10 credits from the player for another play of the game; enables the player to actuate one of spin buttons 250, 350, 450, 550, and 650 to initiate a spin of the reels and to select the feature associated with that actuated spin button (or to cause the gaming system to randomly select one of the features) for the play of the game; receives an actuation of spin button 550 associated with component 500 and the award increase feature; and displays the reels spinning. The gaming system: (a) determines that component 500 has the designated relationship with component 400 and with component 600, and (b) randomly determines to provide the play of the game without the award increase feature associated with component 500 associated with the actuated spin button 550 and to use the award increase feature to modify the symbol removal feature associated with component 600. The gaming system displays the following message in message box 260: "YOU SELECTED THE AWARD INCREASE FEATURE! THE AWARDS ASSOCIATED WITH A RANDOMLY SELECTED SYMBOL WILL BE INCREASED!"

Figure 2M:
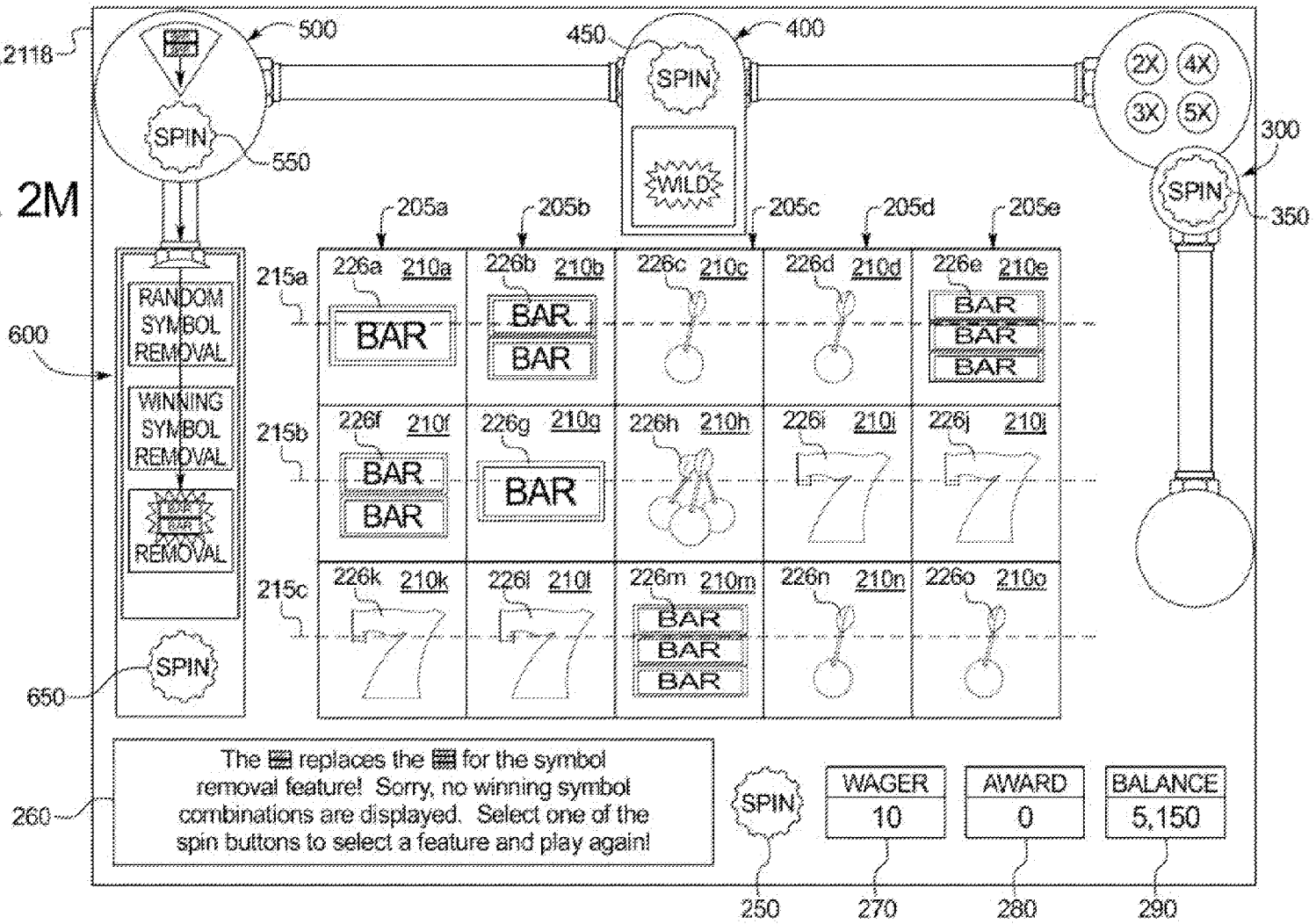

Turning to FIG. 2M, the gaming system randomly determines the Double Bar symbol in association with the award increase feature and displays the randomly determined Double Bar symbol in association with component 500. The gaming system modifies the symbol removal feature by replacing the designated symbol (which is the Triple Bar symbol in this example) associated with the symbol removal feature with the Double Bar symbol. The modified symbol removal feature is available for at least one subsequent play of the game. The gaming system stops the reels such that a plurality of the symbols are displayed at the symbol display areas. In this illustrated example, the gaming system displays: Bar symbol 226*a* at symbol display area 210*a*, Double Bar symbol 226*b* at symbol display area 210*b*, Cherry symbol 226*c* at symbol display area 210*c*, Cherry symbol 226*d* at symbol display area 210*d*, Triple Bar symbol 226*e* at symbol display area 210*e*, Double Bar symbol 226*f* at symbol display area 210*f*, Bar symbol 226*g* at symbol display area 210*g*, Triple Cherry symbol 226*h* at symbol display area 210*h*, Seven symbol 226*i* at symbol display area 210*i*, Seven symbol 226*j* at symbol display area 210*j*, Seven symbol 226*k* at symbol display area 210*k*, Seven symbol 226*l* at symbol display area 210*l*, Triple Bar symbol 226*m* at symbol display area 210*m*, Cherry symbol 226*n* at symbol display area 210*n*, and Cherry symbol 226*o* at symbol display area 210*o*.

The gaming system makes an award determination by determining (based on the paytable, which is not shown) whether the symbols displayed at the symbol display areas form any of the winning symbol combinations along paylines 215*a*, 215*b*, and/or 215*c*. In this example, the gaming system determines that none of the winning symbol combinations are displayed. The gaming system displays the following message in message box 260: "THE DOUBLE BAR REPLACES THE TRIPLE BAR AS THE DESIGNATED SYMBOL FOR THE SYMBOL REMOVAL FEATURE!SORRY, NO WINNING SYMBOL COMBINATIONS ARE DISPLAYED. SELECT ONE OF THE SPIN BUTTONS TO SELECT A FEATURE AND PLAY AGAIN!"

Figure 2N:
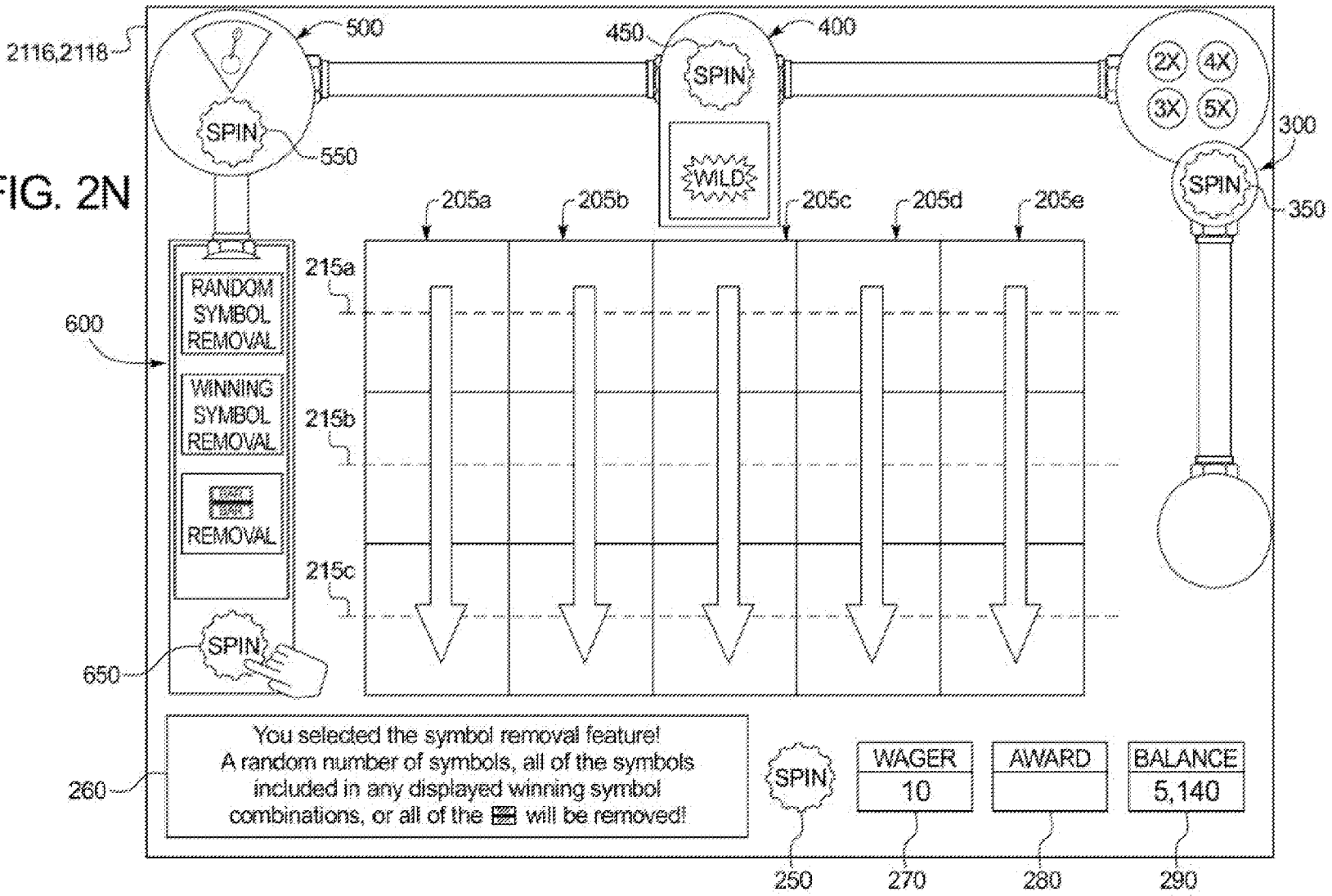

As illustrated in FIG. 2N, the gaming system receives another wager of 10 credits from the player for another play of the game; enables the player to actuate one of spin buttons 250, 350, 450, 550, and 650 to initiate a spin of the reels and to select the feature associated with that actuated spin button (or to cause the gaming system to randomly select one of the features) for the play of the game; receives an actuation of spin button 650 associated with component 600 and the modified symbol removal feature; and displays the reels spinning. The gaming system: (a) determines that component 600 does not have a designated relationship with any of the other components, and (b) provides the play of the game in accordance with the modified symbol removal feature associated with component 600 associated with the actuated spin button 650. The gaming system displays the following message in message box 260: "YOU SELECTED THE SYMBOL REMOVAL FEATURE! A RANDOM NUMBER OF SYMBOLS, ALL OF THE SYMBOLS INCLUDED IN ANY DISPLAYED WINNING SYMBOL COMBINATIONS, OR ALL OF THE DOUBLE BAR WILL BE REMOVED!"

Figure 2O:
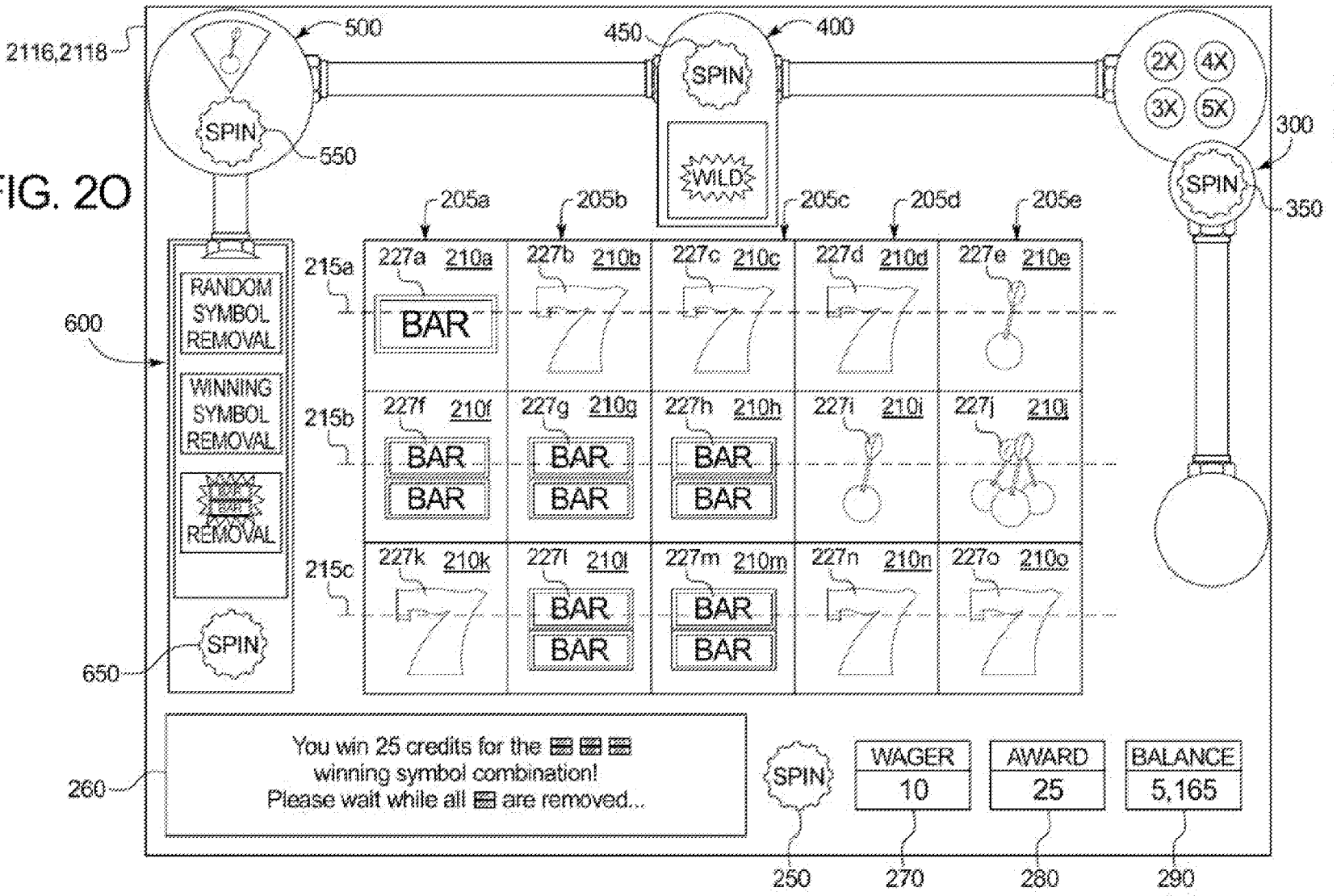

Turning to FIG. 2O, the gaming system stops the reels such that a plurality of the symbols are displayed at the remaining symbol display areas. In this illustrated example, the gaming system displays: Bar symbol 227*a* at symbol display area 210*a*, Seven symbol 227*b* at symbol display area 210*b*, Seven symbol 227*c* at symbol display area 210*c*, Seven symbol 227*d* at symbol display area 210*d*, Cherry symbol 227*e* at symbol display area 210*e*, Double Bar symbol 227*f* at symbol display area 210*f*, Double Bar symbol 227*g* at symbol display area 210*g*, Double Bar symbol 227*h* at symbol display area 210*h*, Cherry symbol 227*i* at symbol display area 210*i*, Triple Cherry symbol 227*j* at symbol display area 210*j*, Seven symbol 227*k* at symbol display area 210*k*, Double Bar symbol 227*l* at symbol display area 210*l*, Double Bar symbol 227*m* at symbol display area 210*m*, Seven symbol 227*n* at symbol display area 210*n*, and Seven symbol 2270 at symbol display area 210*o*.

The gaming system also randomly determines to remove any instances of the Double Bar symbol (i.e., the designated symbol) generated and displayed at the symbol display areas after determining any awards associated with the displayed symbols.

The gaming system makes an award determination by determining (based on the paytable, which is not shown) whether the symbols displayed at the symbol display areas form any of the winning symbol combinations along paylines 215*a*, 215*b*, and/or 215*c*. In this example, the gaming system determines an award of 25 credits associated with the Double Bar-Double Bar-Double Bar winning symbol combination displayed along payline 215*b*. The gaming system updates award meter 280 and the player's credit balance displayed in credit meter 290 to reflect the 25 credit award. The gaming system displays the following message in message box 260: "YOU WIN AN AWARD OF 25 CREDITS FOR THE DOUBLE BAR DOUBLE BAR DOUBLE BAR WINNING SYMBOL COMBINATION! PLEASE WAIT WHILE ALL OF THE DOUBLE BAR ARE REMOVED . . . . "

Figure 2P:
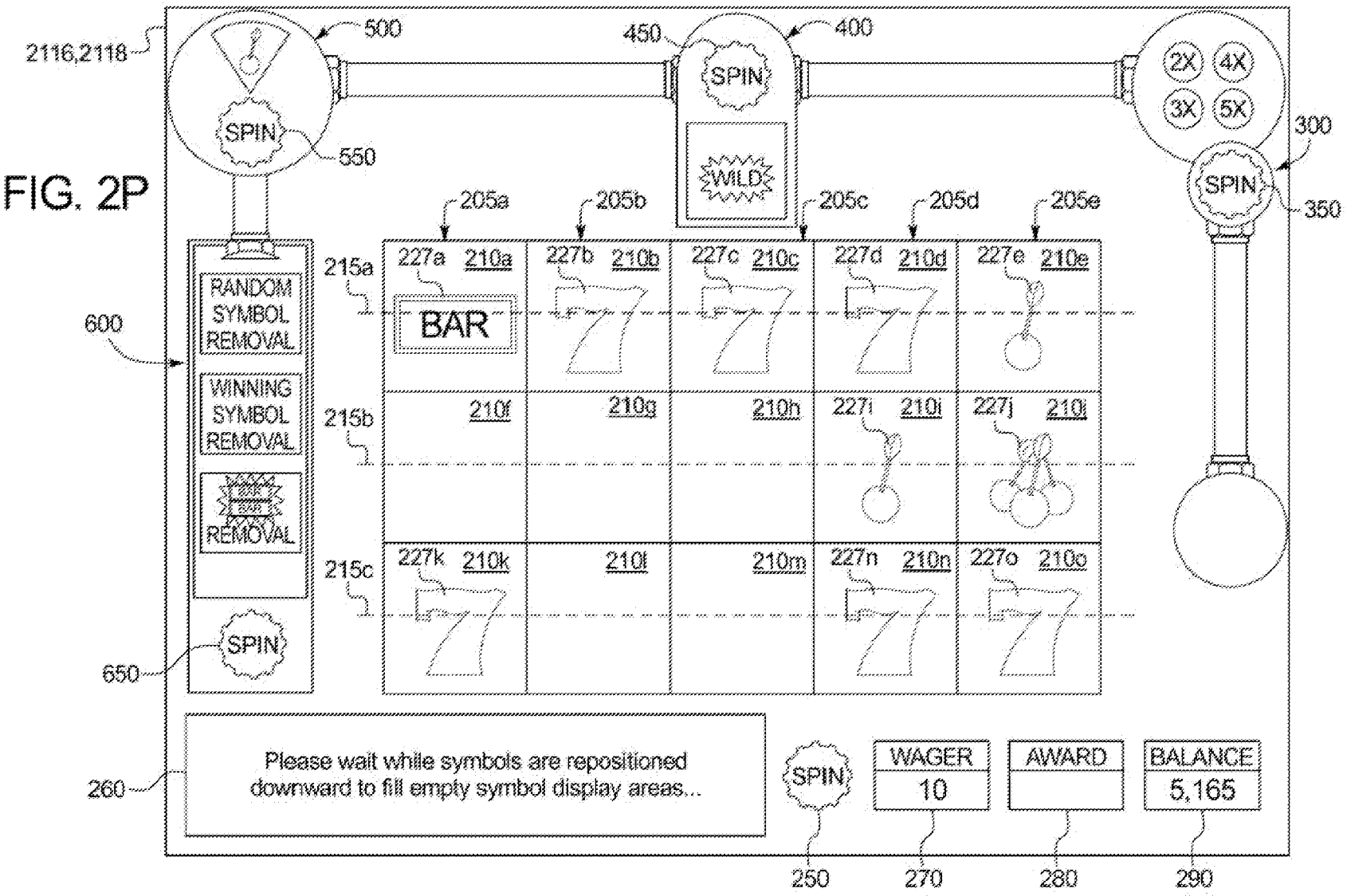

As illustrated in FIG. 2P, the gaming system removes Double Bar symbols 227*f*, 227*g*, 227*h*, 2271, and 227*m* from their respective symbol display areas to create empty symbol display areas. The gaming system displays the following message in message box 260: "PLEASE WAIT WHILE THE SYMBOLS ARE REPOSITIONED DOWNWARD TO FILL EMPTY SYMBOL DISPLAY AREAS . . . . "

Figure 2Q:
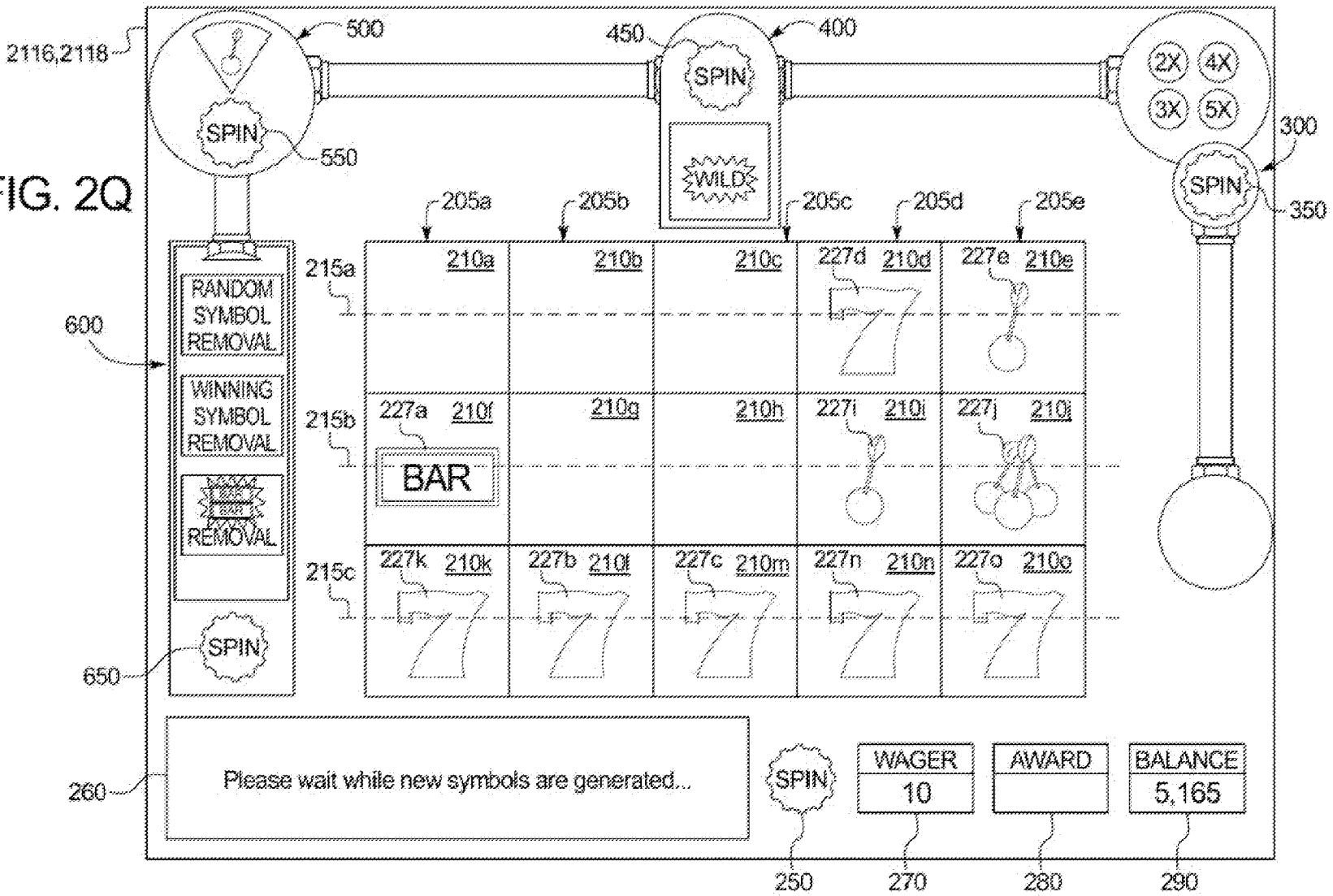

As illustrated in FIG. 2Q, the gaming system shifts the remaining displayed symbols downward to fill the empty symbol display areas such that: Bar symbol 227*a* is displayed at symbol display area 210*f*, Seven symbol 227*b* is displayed at symbol display area 210*l*, and Seven symbol 227*c* is displayed at symbol display area 210*m*. The gaming system displays the following message in message box 260: "PLEASE WAIT WHILE NEW SYMBOLS ARE GENERATED . . . . "

Figure 2R:
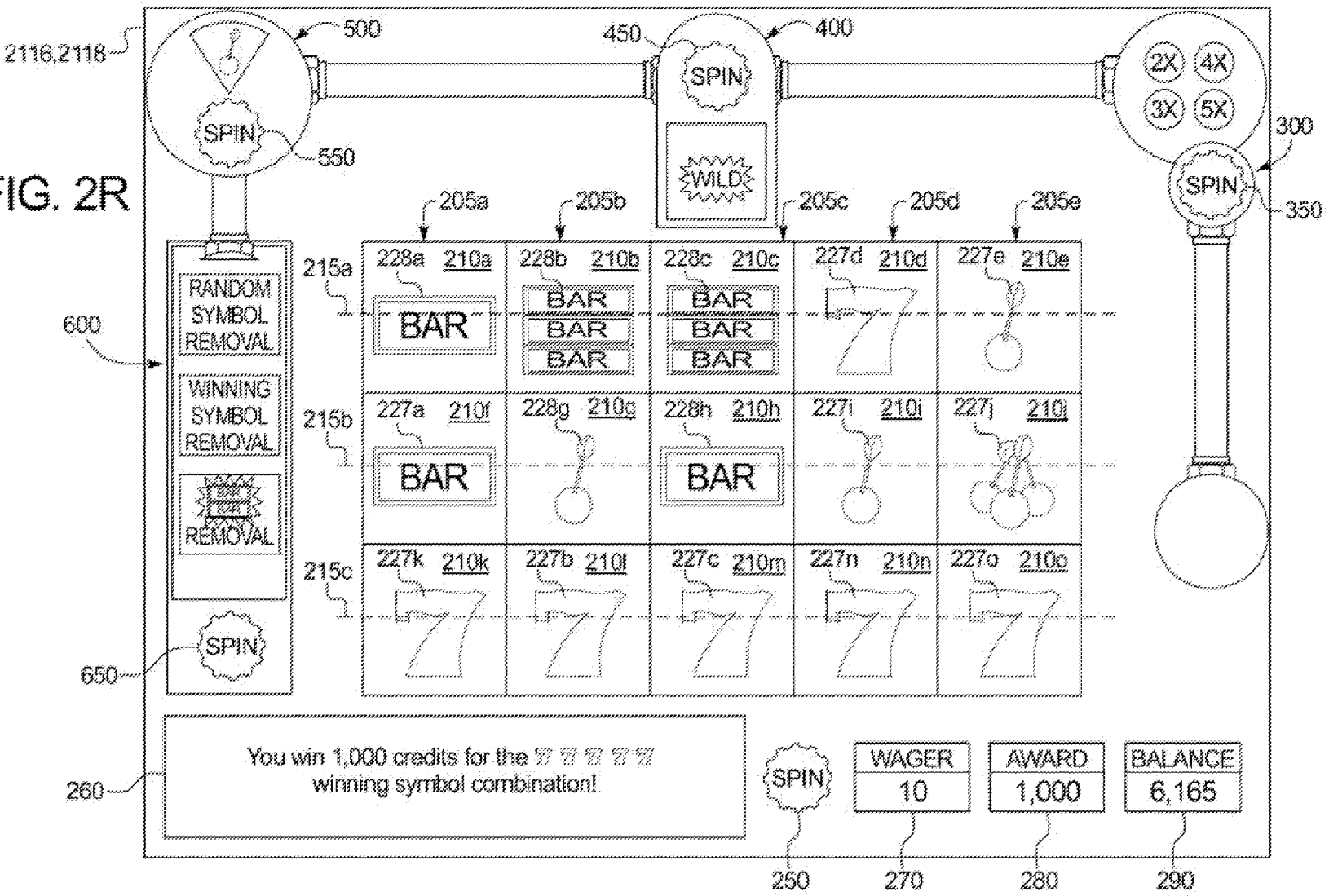

As illustrated in FIG. 2R, for each remaining empty symbol display area, the gaming system generates and displays one of the plurality of symbols at that empty symbol display area to fill that empty symbol display area. More specifically, the gaming system generates and displays: Bar symbol 228*a* at symbol display area 210, Triple Bar symbol 228*b* at symbol display area 210*b*, Triple Bar symbol 228*c* at symbol display area 210*c*, Cherry symbol 228*g* at symbol display area 210*g*, and Bar symbol 228*h* at symbol display area 210*h*.

The gaming system makes another award determination by determining (based on the paytable, which is not shown) whether the symbols displayed at the symbol display areas form any of the winning symbol combinations along paylines 215*a*, 215*b*, and/or 215*c*. In this example, the gaming system determines an award of 1,000 credits associated with the Seven-Seven-Seven-Seven-Seven winning symbol combination displayed along payline 215*c*. The gaming system updates award meter 280 and the player's credit balance displayed in credit meter 290 to reflect the 1,000 credit award. The gaming system displays the following message in message box 260: "YOU WIN AN AWARD OF 1,000 CREDITS FOR THE 7 7 7 7 7 WINNING SYMBOL COMBINATION!"

In various embodiments, such as the example described above with respect to FIGS. 2A to 2R, the feature (or modified feature) associated with the component associated with the actuated spin button is the only feature (or modified feature) that may be employed for the play of the game. In other embodiments, features (or modified features) other than the feature (or modified feature) associated with the component associated with the actuated spin button may additionally be employed for the play of the game. For instance, in one example, on random occasions the gaming system employs each feature (or modified features) associated with each component for a play of the game.

In certain embodiments, such as the example described above with respect to FIGS. 2A to 2R, the gaming system enables the player to actuate a single one of the spin buttons (and, therefore, select a single one of the features) for a play of the game. In other embodiments, the gaming system enables the player to actuate up to a designated quantity of at least two of the spin buttons (and, therefore, select at least two of the features) for a play of the game.

In certain embodiments, each play of the game has the same average expected payback percentage, regardless of: (a) which feature(s) are employed for that play of the game, (b) how many feature(s) are employed for that play of the game, (c) whether any feature(s) is employed for that play of the game, and (d) whether any modified feature(s) is employed for that play of the game. In other embodiments, the average expected payback percentage of a play of the game varies based on at least one of: (a) which feature(s) are employed for that play of the game, (b) how many feature(s) are employed for that play of the game, (c) whether any feature(s) is employed for that play of the game, and (d) whether any modified feature(s) is employed for that play of the game. For instance, in one example, the average expected payback percentage of a play of the game in which no features are employed is less than the average expected payback percentage of a play of the game in which a single feature is employed, and the average expected payback percentage of a play of the game in which a single feature is employed is less than the average expected payback percentage of a play of the game in which multiple features are employed. It should be appreciated that, in various embodiments, the average expected payback percentage is at least a minimum average expected payback percentage and no more than a maximum average expected payback percentage.

In certain embodiments, at least one of: (a) which feature(s) are employed for that play of the game, (b) how many feature(s) are employed for that play of the game, (c) whether any feature(s) is employed for that play of the game, and (d) whether any modified feature(s) is employed for that play of the game affects one or more of: (a) the volatility of the game for that play, (b) the hit frequency of the game for that play, (c) the win frequency of the game for that play, and (d) the feature frequency of the game for that play.

It should be appreciated that any suitable features may be employed, such as (but not limited to): (a) a multiplier feature (described above) that causes the gaming system to use a multiplier to modify any determined awards for a play of the game; (b) a symbol drop feature that causes the gaming system to display a randomly selected symbol at a randomly selected number of symbol display areas for a play of the game; (c) a symbol drop feature that causes the gaming system to display a Wild symbol at a randomly selected number of symbol display areas for a play of the game; (d) symbol drop feature that causes the gaming system to display a designated symbol at a randomly selected number of symbol display areas for a play of the game; (e) an award increase feature that causes the gaming system to increase a value of the award(s) associated with a randomly-selected symbol for the play of the game; (f) an award increase feature that causes the gaming system to increase a value of the award(s) associated with a designated symbol for the play of the game; (g) a symbol removal feature that causes the gaming system to, after generating and displaying a plurality of symbols at the symbol display areas: (i) remove one of; (1) a randomly selected number of the displayed symbols, (2) the displayed symbols included in any displayed winning symbol combinations, and (3) any displayed instances of a designated symbol; (ii) reposition one or more of the remaining displayed symbols into one or more of the empty symbol display areas (if any); and (iii) thereafter, generate and display symbols at the empty symbol display areas (if any); (h) a symbol replace feature that causes the gaming system to replace the symbols displayed at a randomly selected number of symbol display areas with a randomly selected symbol for a play of the game; (i) a symbol replace feature that causes the gaming system to replace the symbols displayed at a randomly selected number of symbol display areas with a Wild symbol for a play of the game; (j) a symbol replace feature that causes the gaming system to replace the symbols displayed at a randomly selected number of symbol display areas with a designated symbol for a play of the game; (k) an extra Wilds feature that causes the gaming system to add one or more Wild symbols to one or more of the reels and/or to replace one or more symbols on the reels with Wild symbols for a play of the game; (l) an extra paylines feature that causes the gaming system to activate one or more additional paylines for a play of the game; (m) an expanding Wilds feature that causes the gaming system to replace at least one Wild symbol on the reels with an expanding Wild symbol for a play of the game, add at least one expanding Wild symbol to at least one reel, and/or replace at least one non-Wild symbol on at least one reel with an expanding Wild symbol; (n) a split symbols feature that causes the gaming system to add one or more split symbols to one or more of the reels and/or replace one or more of the symbols on one or more of the reels with split symbols for a play of the game; (o) a cascading symbols feature that causes the gaming system to, after determining any awards associated with the displayed symbols: (i) remove any symbols included in any displayed winning symbol combinations, (ii) shift any remaining symbols downward to fill any empty symbol display areas, (iii) generate and display symbols in any remaining empty symbol display areas, and (iv) make an additional award determination; (p) a bonus availability feature that causes the gaming system to qualify the player to win a play of a bonus game for a play of the game; (q) a progressive availability feature that causes the gaming system to qualify the player for a progressive award for a play of the game; (r) a symbol stack feature that causes the gaming system to include a stack of a plurality of instances of a given symbol adjacent to one another on at least one reel; (s) an on-reel bonus feature that causes the gaming system to enable a player to pick one of a plurality of selections associated with awards; and/or (t) a super stack feature that determines which of the symbols is included in a stack of a plurality of instances of that symbol adjacent to one another on a reel.

In certain embodiments employing the symbol drop feature, the number of symbol display areas at which the gaming system displays the symbol associated with the symbol drop feature varies based on a value of the symbol. In one example, if the symbol associated with the symbol drop feature is a Wild symbol, the gaming system displays the Wild symbol at a relatively low number of symbol display areas, while if the symbol associated with the symbol drop feature is a less valuable major symbol, the gaming system displays the major symbol at a relatively high number of symbol display areas. In other embodiments employing the symbol drop feature, the placement of the symbol associated with the symbol drop feature (i.e., the specific symbol display areas at which the symbol is displayed) varies based on a value of the symbol. In one example, if the symbol associated with the symbol drop feature is a Wild symbol, the gaming system displays the Wild symbol at less lucrative symbol display areas (such as at symbol display areas associated with the rightmost reel), while if the symbol associated with the symbol drop feature is a less valuable major symbol, the gaming system displays the major symbol at more lucrative symbol display areas (such as at symbol display areas associated with the leftmost reel).

In certain embodiments, the gaming system provides the play of the game in accordance with the feature associated with the component associated with the actuated spin button and uses that feature to modify one of the features associated with another one of the components. In other embodiments, regardless of whether the gaming system provides the play of the game in accordance with the feature associated with the component associated with the actuated spin button, the gaming system additionally randomly determines whether to use that feature to modify one of the features associated with another one of the components.

In various embodiments, if the gaming system determines to modify a first feature using a second feature, the gaming system modifies the first feature using the second feature regardless of whether the first feature has already been modified. For example, if: (a) the gaming system already modified the symbol drop feature using the multiplier feature such that the symbol drop feature is associated with a 2× Seven symbol, (b) the gaming system receives an actuation of the spin button associated with the award increase feature for a play of the game, (c) the gaming system determines not to provide the award increase feature in association with the play of the game, and (d) the gaming system determines to use the award increase feature to modify the (already modified) symbol drop feature, the gaming system; (i) randomly determines one of the symbols (such as a Wild symbol), and (ii) replaces the Seven symbol with the randomly determined Wild symbol to create a (twice) modified symbol drop feature associated with a 2× Wild symbol.

In certain embodiments, if the gaming system determines to display a play of a game without the feature associated with the component associated with the actuated spin button, the gaming system does not automatically modify another feature with the feature associated with the component associated with the actuated spin button. Rather, in these embodiments, in such a case the gaming system randomly determines whether to modify another feature, and does so if the gaming system determines to do so. If, on the other hand, the gaming system determines not to modify another feature, the gaming system does not modify any other feature using the feature associated with the component associated with the actuated spin button.

In other embodiments, if the gaming system determines to modify a first feature using a second feature and the first feature has already been modified, the gaming system replaces the prior modification with the current modification. For example, if: (a) the gaming system already modified the symbol drop feature using the multiplier feature such that the symbol drop feature is associated with a 2× Seven symbol, (b) the gaming system receives an actuation of the spin button associated with the award increase feature for a play of the game, (c) the gaming system determines not to provide the award increase feature in association with the play of the game, and (d) the gaming system determines to use the award increase feature to modify the (already modified) symbol drop feature, the gaming system: (i) randomly determines one of the symbols (such as a Wild symbol), and (ii) replaces the 2× Seven symbol with the randomly determined Wild symbol to create a modified symbol drop feature associated with the Wild symbol.

In one embodiment, each of one or more of the components has a designated relationship with at least one of the other components. In another embodiment, each of the components has a designated relationship with at least one of the other components. In certain embodiments, the designated relationship is a one-way relationship such that when a first component has a designated relationship with a second component, the second component does not necessarily have a designated relationship with the first component. In other embodiments, the designated relationship is a two-way relationship such that when a first component has a designated relationship with a second component, the second component has a designated relationship with the first component.

In one embodiment, the gaming system vaguely indicates the features associated with the displayed components and/or the designated relationships among the displayed components to the player (such as via a help screen). In this embodiment, the limited information encourages the player to play the game to learn the features associated with the components and how the components interact with one another. In another embodiment, the gaming system extensively indicates the features associated with the displayed components and/or the designated relationships among the displayed components to the player (such as in a help screen). In another embodiment, the gaming system indicates information about a particular component (and its associated feature) to the player if the player has actuated the spin button associated with that component at least a designated quantity of times.

In various embodiments, when the actuated spin button is associated with a component associated with a modified feature, the gaming system determines whether to: (a) provide the play of the game in accordance with that modified feature or (b) modify another feature using that modified feature.

In other embodiments, when the actuated spin button is associated with a component associated with a modified feature, the gaming system determines whether to: (a) provide the play of the game in accordance with that modified feature, (b) provide the play of the game in accordance with that feature without the modification, (c) modify another feature using that modified feature, or (d) provide the play of the game in accordance with that feature without the modification and modify another feature using the modification.

In various embodiments, the set of components, the set of associated features, and the arrangement of the displayed components are the same for all players and for all instances of the game. In other embodiments, at least one of the set of components, the set of associated features, and the arrangement of the displayed components are different for at least two players and/or for at least two instances of the game. For instance, in one example, two players play the game including the same set of components and the same set of features, but the arrangement of the displayed components differs between the two players. In another example, two players play the game including the same set of features, but the components associated with those features and the arrangement of the displayed components differ between the two players. In another example, each player's set of components, set of features, and displayed component arrangement is unique.

In certain embodiments, the gaming system stores a pool of features and a pool of components. In these embodiments, the gaming system selects the components to include in the set of components and the associated features to include in the set of features from the pool.

It should be appreciated that a feature may modify another feature in one or more of a variety of different manners. For instance, in one example embodiment, the award increase feature modifies the symbol removal feature by replacing the designated symbol associated with the symbol removal feature with another symbol. In another example embodiment, the award increase feature modifies the symbol removal feature by increasing the awards associated with the designated symbol. In another example embodiment, the award increase feature modifies the symbol removal feature by: (a) replacing the designated symbol associated with the symbol removal feature with another symbol, and (b) increasing the awards associated with the designated symbol.

In one embodiment, the gaming system requires the player to pay a fee or place an additional wager to activate the set of components. That is, in this embodiment, if the player does not pay the fee or place the additional wager, the gaming system provides a play of the game without any of the components and without modifying any of the components.

It should further be appreciated that:

(a) the quantity of reels;
(b) the quantity of symbol display areas;
(c) the quantity of paylines;
(d) the symbol display areas with which the paylines are associated;
(e) the quantity of components in the set of components;
(f) which components are in the set of components;
(g) the manner in which the components of the set of components are determined;
(h) the quantity of features in the set of features;
(i) which features are in the set of features;
(j) the manner in which the features of the set of features are determined;
(k) whether the designated relationships are one-way or two-way;
(l) the designated relationships;
(m) which components have the designated relationship with at least one other component;
(n) the quantity of components having the designated relationship with at least one other component;
(o) how each feature modifies or is modified by each other feature;
(p) whether to provide the feature associated with the component associated with the actuated spin button;
(q) if a component has the designated relationship with a plurality of other components, which of the features of those other components to modify;
(r) the quantity of plays or amount of time for which a modified feature is available;
(s) when the symbol drop feature is employed, the quantity of symbol display areas at which the gaming system displays the symbol associated with the symbol drop feature;
(t) when the symbol drop feature is employed, which symbol display areas at which the gaming system displays the symbol associated with the symbol drop feature;
(u) the symbol associated with the symbol drop feature;
(v) the symbol associated with the award increase feature;
(w) the multiplier associated with the multiplier feature;
(x) the designated symbol associated with the symbol removal feature;
(y) the features in the pool of features;
(z) the components in the pool of components;
(aa) the quantity of spin buttons the gaming system enables the player to actuate for a play of the game;
(bb) the quantity of features or modified features that may be employed for a play of the game;
(cc) the game; and/or
(dd) any other variables or determinations described herein may be: (1) predetermined; (2) randomly determined; (3) randomly determined based on one or more weighted percentages; (4) determined based on a generated symbol or symbol combination; (5) determined independent of a generated symbol or symbol combination; (6) determined based on a random determination by a central controller (described below); (7) determined independent of a random determination by the central controller; (8) determined based on a random determination at an electronic gaming machine (EGM) configured to operate the slot game (described below); (9) determined independent of a random determination at the EGM: (10) determined based on at least one play of at least one game; (11) determined independent of at least one play of at least one game; (12) determined based on a player's selection; (13) determined independent of a player's selection; (14) determined based on one or more side wagers placed; (15) determined independent of one or more side wagers placed; (16) determined based on the player's primary game wager or wager level; (17) determined independent of the player's primary game wager or wager level; (18) determined based on time (such as the time of day); (19) determined independent of time (such as the time of day); (20) determined based on an amount of coin-in accumulated in one or more pools; (21) determined independent of an amount of coin-in accumulated in one or more pools; (22) determined based on a status of the player (i.e., a player tracking status); (23) determined independent of a status of the player (i.e., a player tracking status); (24) determined based on one or more other determinations disclosed herein; (25) determined independent of any other determination disclosed herein; and/or (26) determined in any other suitable manner or based on or independent of any other suitable factor(s).

Bonus Round Associated with a Plurality of Different Unlockable Features

Other embodiments of the present disclosure are directed to a gaming system and method configured to operate a bonus round associated with a plurality of different unlockable features. It should be appreciated that the bonus round may additionally or alternatively be employed as a primary game. Moreover, while any credit balances, any wagers, and any awards are displayed as an amount of monetary credits or currency in the embodiments described below, one or more of such credit balances, such wagers, and such awards may be for non-monetary credits, promotional credits, and/or player tracking points or credits.

Figure 3:
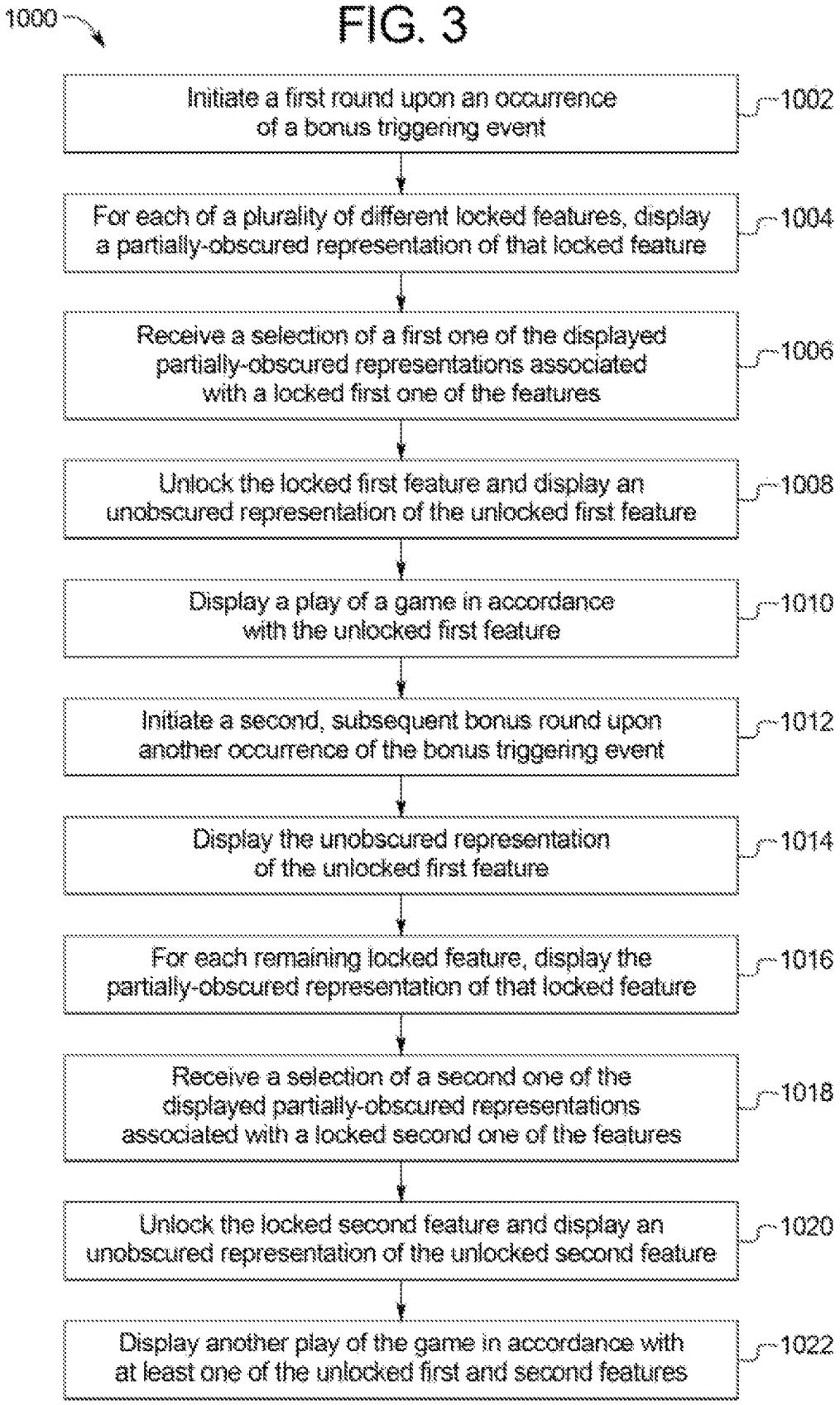
FIG. 3 is a flowchart illustrating a method of operating an example embodiment of the gaming system of the present disclosure that provides a bonus round associated with a plurality of different unlockable features.

FIG. 3 illustrates a flowchart of an example process or method 1000 of operating the gaming system of the present disclosure. In various embodiments, process 1000 is represented by a set of instructions stored in one or more memories and executed by one or more processors. Although process 1000 is described with reference to the flowchart shown in FIG. 3, it should be appreciated that many other processes of performing the acts associated with this illustrated process 1000 may be employed. For example, the order of certain of the illustrated blocks may be changed, certain of the illustrated blocks may be optional, and/or certain of the illustrated blocks may not be employed.

More specifically, in one example embodiment, the gaming system initiates a first bonus round upon an occurrence of a bonus triggering event, as indicated by block 1002. For each of a set of a plurality of different locked features, the gaming system displays a partially-obscured representation of that locked feature, as indicated by block 1004. The gaming system receives a selection of a first one of the displayed partially-obscured representations associated with a locked first one of the features, as indicated by block 1006. The gaming system unlocks that locked first feature and displays an unobscured representation of the unlocked first feature, as indicated by block 1008. The gaming system displays a play of a game in accordance with the unlocked first feature, as indicated by block 1010. Upon another occurrence of the bonus triggering event, the gaming system initiates a second, subsequent bonus round, as indicated by block 1012. The gaming system displays the unobscured representation of the unlocked first feature, as indicated by block 1014. For each remaining locked feature, the gaming system displays the partially-obscured representation of that locked feature, as indicated by block 1016. The gaming system receives a selection of a second one of the displayed partially-obscured representations associated with a locked second one of the features, as indicated by block 1018. The gaming system unlocks the locked second feature and displays an unobscured representation of the unlocked second feature, as indicated by block 1020. The gaming system displays another play of the game in accordance with at least one of the unlocked first and second features, as indicated by block 1022.

FIGS. 4A, 4B, 4C, and 4D illustrate screen shots of another example embodiment of the gaming system of the present disclosure providing examples of a plurality of bonus rounds according to process 1000 described above. In this example, the bonus round is associated with a set of a plurality of different features, including a multiplier feature, a symbol drop feature, an award increase feature, and a symbol removal feature, each of which is described above. Upon a first initiation of the bonus round, each of the features is locked and, for each locked feature, the gaming system displays a partially-obscured representation of that feature. In this example, each displayed partially-obscured representation of a locked feature is configured such that some, but not all, of the information associated with that locked feature is apparent. In this example, for a given player, the gaming system stores the set of features and their locked/unlocked status in association with that player, such as through use of a player tracking account. This persistence effect enables the player to unlock and employ different features as the player triggers more and more bonus rounds.

In this example, each time the player achieves entry into the bonus round, the gaming system enables the player to unlock one of the locked features (if any) by selecting one of the displayed partially-obscured representations of the locked features (if any). The gaming system unlocks the locked feature associated with the selected partially-obscured representation, and displays an unobscured representation of the unlocked feature. In this example, the gaming system provides each free spin of the bonus round in accordance with at least one of the unlocked features.

Figure 4A:
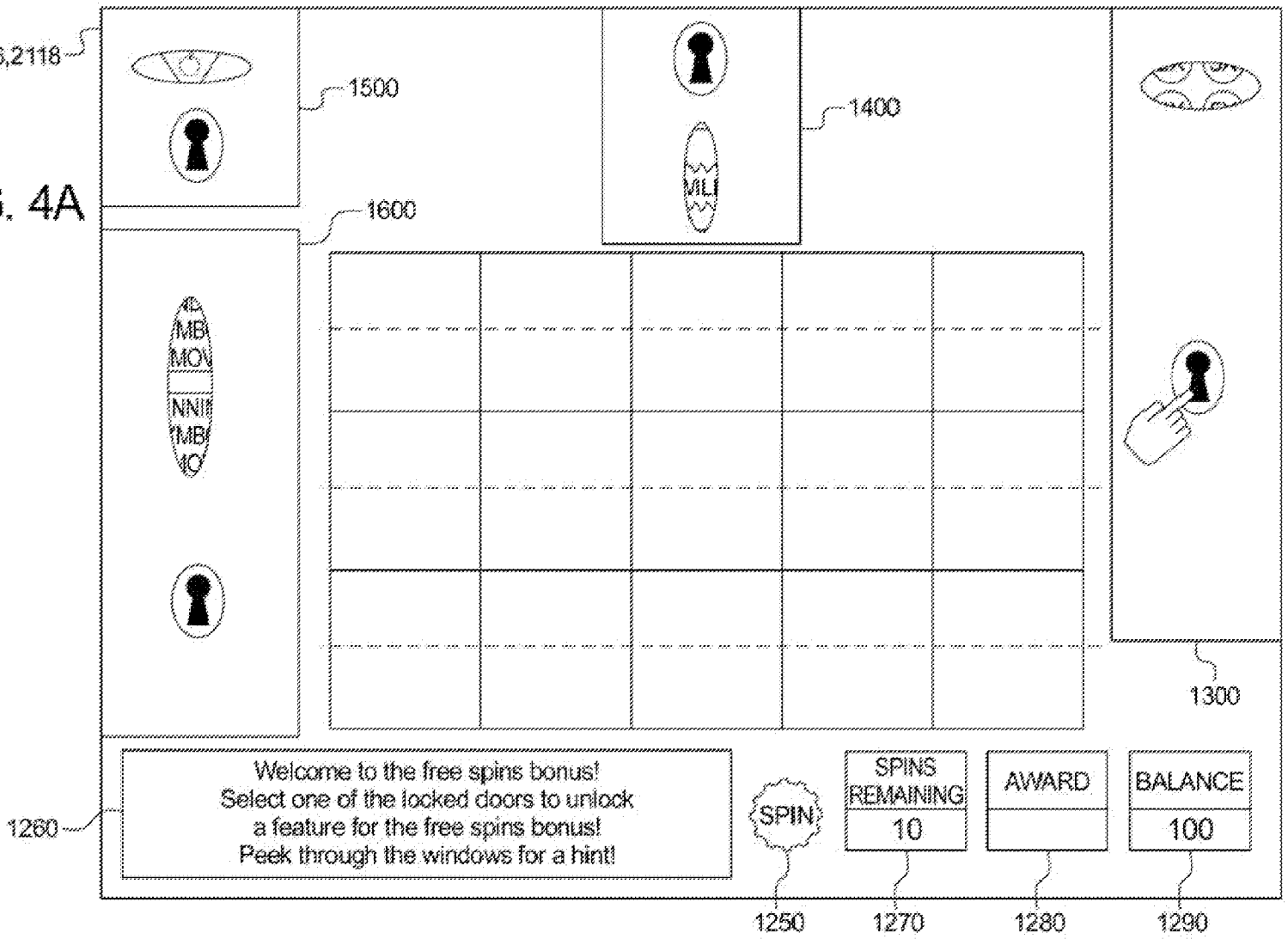
FIGS. 4A, 4B, 4C, and 4D illustrate screen shots of another example embodiment of the gaming system of the present disclosure providing a plurality of bonus rounds according to according to the method of FIG. 3.
Figure 4B:
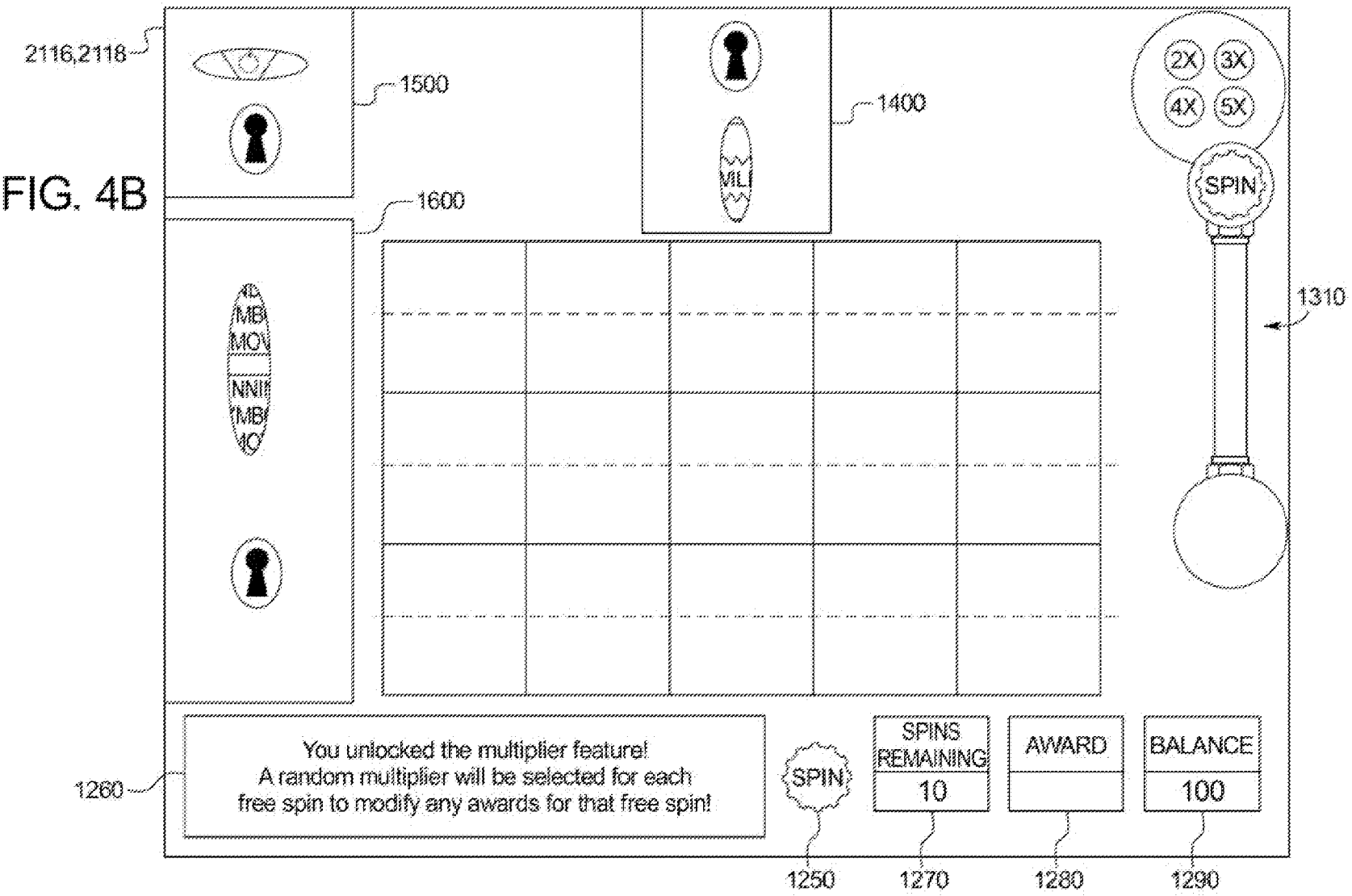

Turning to FIG. 4A, upon initiation of a first bonus round, each of the features is locked, and the gaming system displays a partially-obscured representation 1300 of the multiplier feature, a partially-obscured representation 1400 of the symbol drop feature, a partially-obscured representation 1500 of the award increase feature, and a partially-obscured representation 1600 of the symbol removal feature. More specifically, in this example, each partially-obscured representation includes a locked door having a window that enables the player to view certain information about the locked feature represented by that displayed partially-obscured representation. This provides the player with some, but not all, of the information about the feature behind each locked door and/or the functionality of the feature behind each locked door. It should be appreciated that any suitable display (either static or animated) may be employed as the partially-obscured representation. The gaming system enables the player to select one of the displayed partially-obscured representations to unlock the locked feature associated with that selected partially-obscured representation. The gaming system displays the following message in message box 1260: "WELCOME TO THE FREE SPINS BONUS! SELECT ONE OF THE LOCKED DOORS TO UNLOCK A FEATURE FOR THE FREE SPINS BONUS! PEEK THROUGH THE WINDOWS FOR A HINT!"

As illustrated in FIG. 48, in this example, the gaming system receives a selection of the partially-obscured representation 1300 of the multiplier feature from the player. Accordingly, the gaming system unlocks the locked multiplier feature and displays an unobscured representation 1310 of the unlocked multiplier feature. The gaming system then provides one or more free spins for the first bonus round in accordance with the unlocked multiplier feature (not shown). The gaming system displays the following message in message box 1260: "YOU UNLOCKED THE MULTIPLIER FEATURE! A RANDOM MULTIPLIER WILL BE

SELECTED FOR EACH FREE SPIN TO MODIFY ANY AWARDS FOR THAT FREE SPIN!"

Figure 4C:
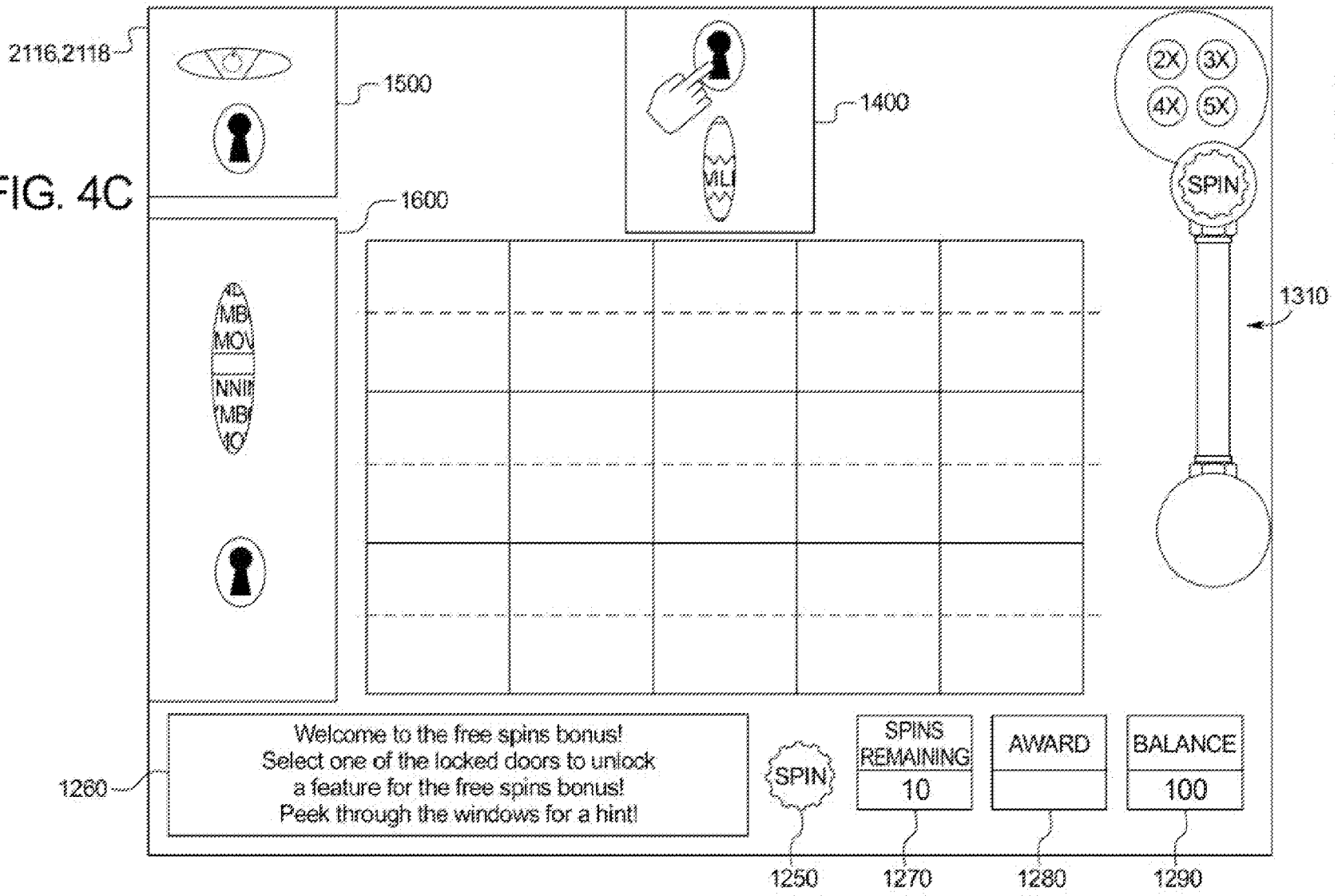

Turning to FIG. 4C, upon initiation of a second subsequent bonus round, the multiplier feature remains unlocked while the symbol drop feature, the award increase feature, and the symbol removal feature each remain locked. The gaming system displays the unobscured representation 1310 of the unlocked multiplier feature and the partially-obscured representations 1400, 1500, and 1600 of the symbol drop, award increase, and symbol removal features, respectively. The gaming system enables the player to select one of the displayed partially-obscured representations to unlock the locked feature associated with that selected partially-obscured representation. The gaming system displays the following message in message box 1260: "WELCOME TO THE FREE SPINS BONUS! SELECT ONE OF THE LOCKED DOORS TO UNLOCK A FEATURE FOR THE FREE SPINS BONUS! PEEK THROUGH THE WINDOWS FOR A HINT!"

Figure 4D:
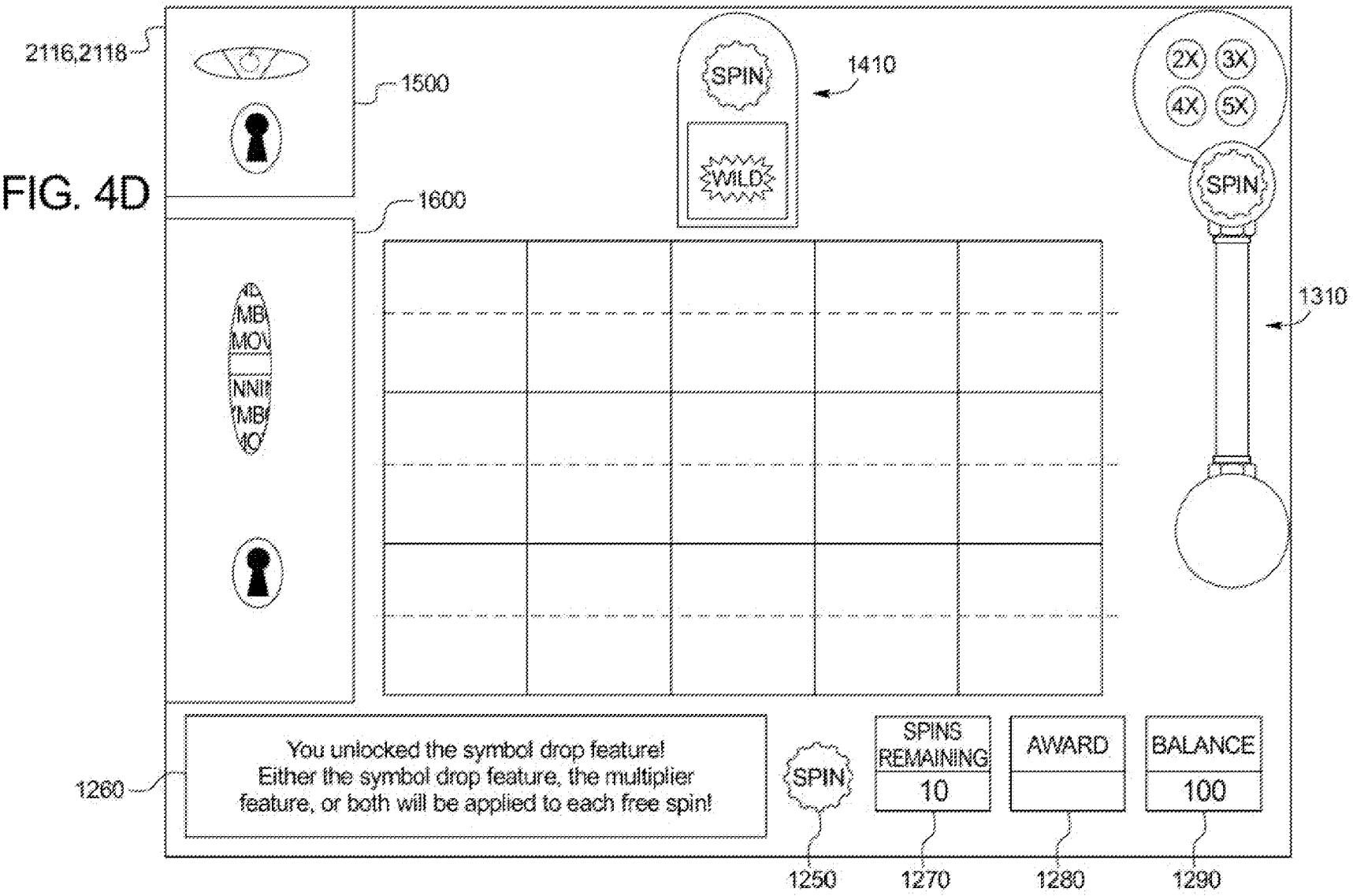

As illustrated in FIG. 4D, in this example, the gaming system receives a selection of the partially-obscured representation 1400 of the symbol drop feature from the player. Accordingly, the gaming system unlocks the locked symbol drop feature and displays an unobscured representation 1410 of the unlocked symbol feature. The gaming system then provides each of one or more free spins for the second bonus round in accordance with at least one of the unlocked multiplier feature and the unlocked symbol drop feature (not shown). In this example, the gaming system randomly selects which of the unlocked features to employ for each free spin. The gaming system displays the following message in message box 1260: "YOU UNLOCKED THE SYMBOL DROP FEATURE! EITHER THE SYMBOL DROP FEATURE, THE MULTIPLIER FEATURE, OR BOTH WILL BE APPLIED TO EACH FREE SPIN!"

In certain embodiments, such as the one described above with respect to FIGS. 4A to 4D, the gaming system employs only one of the unlocked features for each play of each game in the bonus round. In other embodiments, the gaming system may employ up to a designated quantity of at least two features for at least one play of at least one game in the bonus round. In one example embodiment, the gaming system may employ all of the unlocked features for at least one play of at least one game in the bonus round.

In certain embodiments, each play of each game in the bonus round has the same average expected payback percentage, regardless of: (a) which feature(s) are employed for that play of the game, and (b) how many feature(s) are employed for that play of the game. In other embodiments, the average expected payback percentage of a play of a game varies based on at least one of: (a) which feature(s) are employed for that play of the game, and (b) how many feature(s) are employed for that play of the game. For instance, in one example, the average expected payback percentage of a play of a game in which a single feature is employed is less than the average expected payback percentage of a play of the game in which multiple features are employed. It should be appreciated that, in such embodiments, the average expected payback percentage is at least a minimum average expected payback percentage and no more than a maximum average expected payback percentage.

In various embodiments, at least one of (a) which feature(s) are employed for that play of the game, and (b) how many feature(s) are employed for that play of the game affects one or more of: (a) the volatility of the game for that play, (b) the hit frequency of the game for that play. (c) the win frequency of the game for that play, and (d) the feature frequency of the game for that play.

It should be appreciated that any suitable features may be employed, such as (but not limited to): (a) a multiplier feature (described above) that causes the gaming system to use a multiplier to modify any determined awards for a play of the game; (b) a symbol drop feature that causes the gaming system to display a randomly selected symbol at a randomly selected number of symbol display areas for a play of the game; (c) a symbol drop feature that causes the gaming system to display a Wild symbol at a randomly selected number of symbol display areas for a play of the game: (d) symbol drop feature that causes the gaming system to display a designated symbol at a randomly selected number of symbol display areas for a play of the game; (e) an award increase feature that causes the gaming system to increase a value of the award(s) associated with a randomly-selected symbol for the play of the game; (f) an award increase feature that causes the gaming system to increase a value of the award(s) associated with a designated symbol for the play of the game; (g) a symbol removal feature that causes the gaming system to, after generating and displaying a plurality of symbols at the symbol display areas: (i) remove one of: (1) a randomly selected number of the displayed symbols, (2) the displayed symbols included in any displayed winning symbol combinations, and (3) any displayed instances of a designated symbol; (ii) reposition one or more of the remaining displayed symbols into one or more of the empty symbol display areas (if any); and (iii) thereafter, generate and display symbols at the empty symbol display areas (if any); (h) a symbol replace feature that causes the gaming system to replace the symbols displayed at a randomly selected number of symbol display areas with a randomly selected symbol for a play of the game; (i) a symbol replace feature that causes the gaming system to replace the symbols displayed at a randomly selected number of symbol display areas with a Wild symbol for a play of the game; (j) a symbol replace feature that causes the gaming system to replace the symbols displayed at a randomly selected number of symbol display areas with a designated symbol for a play of the game; (k) an extra Wilds feature that causes the gaming system to add one or more Wild symbols to one or more of the reels and/or to replace one or more symbols on the reels with Wild symbols for a play of the game; (l) an extra paylines feature that causes the gaming system to activate one or more additional paylines for a play of the game; (m) an expanding Wilds feature that causes the gaming system to replace at least one Wild symbol on the reels with an expanding Wild symbol for a play of the game, add at least one expanding Wild symbol to at least one reel, and/or replace at least one non-Wild symbol on at least one reel with an expanding Wild symbol; (n) a split symbols feature that causes the gaming system to add one or more split symbols to one or more of the reels and/or replace one or more of the symbols on one or more of the reels with split symbols for a play of the game; (o) a cascading symbols feature that causes the gaming system to, after determining any awards associated with the displayed symbols: (i) remove any symbols included in any displayed winning symbol combinations, (ii) shift any remaining symbols downward to fill any empty symbol display areas, (iii) generate and display symbols in any remaining empty symbol display areas, and (iv) make an additional award determination; (p) a bonus availability feature that causes the gaming system to qualify the player to win a play of a bonus game for a play of the game; (q) a progressive availability feature that causes the gaming system to qualify the player for a progressive award for a play of the game; (r) a symbol stack feature that causes the gaming system to include a stack of a plurality of instances of a given symbol adjacent to one another on at least one reel; (s) an on-reel bonus feature that causes the gaming system to enable a player to pick one of a plurality of selections associated with awards; and/or (t) a super stack feature that determines which of the symbols is included in a stack of a plurality of instances of that symbol adjacent to one another on a reel.

In one embodiment, the gaming system stores a pool including a plurality of different features. In this embodiment, upon initiation of a first bonus round for a player, the gaming system randomly selects a set of a plurality of the features from the pool to include in the bonus round for that player. It should thus be appreciated that different players may have different features in their respective bonus rounds. In one embodiment, each player has a unique combination of available features. It should be appreciated that additional features may be added to and/or removed from the pool over time to maintain player interest, enjoyment, and excitement.

In various embodiments, there may be different types of partially-obscured representations associated with a single feature. For instance, in one example, at least one feature is associated with a plurality of different types of locked doors (i.e., partially-obscured representations of that feature) that have differently-shaped and/or sized windows that reveal different information about that feature or the functionality of that feature.

In one embodiment, the gaming system enables the player to unlock one of the locked features by selecting the displayed partially-obscured representation of that feature upon each initiation of the bonus round. In other embodiments, the gaming system enables the player to unlock one of the locked features by selecting the displayed partially-obscured representation of that feature: (a) upon the first initiation of the bonus round and every Nth (e.g., second, third, fourth, or fifth) initiation of the bonus round thereafter; (b) upon an occurrence of a designated outcome in the base game; or (c) if certain selections are picked during play of a selection game prior to the bonus round.

It should be appreciated that, for a given player, the features included in the set of features for the player's bonus round are: (a) randomly determined, (b) selected from a pool of predetermined features, (c) selected such that the set does not include any features included in any sets of features employed for any prior bonus rounds of the player, (d) selected such that no more than a designated quantity of the features of the set were included in any sets of features employed for any prior bonus rounds of the player, (e) selected such that no set of other player includes the same combination of features, and/or (f) selected such that the set includes a designated quantity of at least one new feature.

For a given player, once all of the features of the player's set have been unlocked, in one embodiment the gaming system determines a new set of locked features for the player. In this embodiment, the next time the player triggers the bonus round, the gaming system enables the player to play the bonus round using the unlocked features of the old set or to play the bonus round using the new set of locked features. In another embodiment, the gaming system enables the player to play the bonus round using the unlocked features of the old set for a limited time and/or for a limited quantity of bonus rounds before requiring the player to use the new set of locked features.

In one embodiment, the gaming system determines a plurality of sets of locked features for a given player. In this embodiment, upon initiation of the bonus round, the gaming system randomly selects one of the sets of locked features to employ for that bonus round. Thus, in this embodiment, upon initiation of each bonus round, the gaming system enables the player to unlock one of the features of one of the sets of features. For instance, in one example, after three initiations of the bonus round, the player has unlocked one feature in a first set of features and two features in a second set of features.

In certain embodiments, the gaming system enables the player to unlock a new or supplemental pool of features upon achieving a designated level of a virtual currency. That is, in these embodiments, a player accumulates virtual currency through game play. When the player achieves a certain level of virtual currency, the gaming system either: (a) unlocks a new pool of features (such as more valuable features) from which the gaming system chooses features to include in the player's set of features for any future bonus rounds, or (b) adds a supplemental pool of features to the current pool of features from which the gaming system chooses features to include in the player's set of features for any future bonus rounds.

In various embodiments, for at least one of the features, the gaming system displays a fully obscured representation of that locked feature such that no information associated with that locked feature is apparent to the player. In certain such embodiments, the degree to which one or more of the displayed representations are obscured is based on one or more factors, such as the player's status, the player's wager level, and the like. For instance, in one example: (a) for a player who placed the minimum wager in the play of the primary game that triggered the bonus round, the gaming system displays fully obscured representations of the locked features; and (b) for a player who placed the maximum wager in the play of the primary game that triggered the bonus round, the gaming system displays partially-obscured representations of the locked features.

It should be appreciated that, in certain embodiments, the features of employed for the bonus round are associated with displayed components, each of one or more of which have a designated relationship with at least one of the other displayed components, as described above.

It should further be appreciated that:

(a) the quantity of features in the set of features;
(b) which features are in the set of features;
(c) the manner in which the features of the set of features are determined;
(d) when the gaming system enables the player to unlock a locked feature;
(d) the quantity of locked features the gaming system enables the player to unlock;
(e) the speed at which the gaming system enables the player to unlock locked features;
(f) how often the gaming system enables the player to unlock locked features;
(g) the type of partially-obscured associated displayed for a given feature;
(h) the game in the bonus round;
(i) the degree to which one or more of the displayed representations are obscured;
(j) the quantity of unlocked features provided for a play of the game; and/or
(k) any other variables or determinations described herein may be: (1) predetermined; (2) randomly determined; (3) randomly determined based on one or more weighted percentages; (4) determined based on a generated symbol or symbol combination; (5) determined independent of a generated symbol or symbol combination; (6) determined based on a random determination by a central controller (described below); (7) determined independent of a random determination by the central controller; (8) determined based on a random determination at an electronic gaming machine (EGM) configured to operate the slot game (described below); (9) determined independent of a random determination at the EGM; (10) determined based on at least one play of at least one game; (11) determined independent of at least one play of at least one game; (12) determined based on a player's selection: (13) determined independent of a player's selection; (14) determined based on one or more side wagers placed; (15) determined independent of one or more side wagers placed; (16) determined based on the player's primary game wager or wager level; (17) determined independent of the player's primary game wager or wager level; (18) determined based on time (such as the time of day); (19) determined independent of time (such as the time of day); (20) determined based on an amount of coin-in accumulated in one or more pools; (21) determined independent of an amount of coin-in accumulated in one or more pools; (22) determined based on a status of the player (i.e., a player tracking status); (23) determined independent of a status of the player (i.e., a player tracking status); (24) determined based on one or more other determinations disclosed herein; (25) determined independent of any other determination disclosed herein; and/or (26) determined in any other suitable manner or based on or independent of any other suitable factor(s).

It should be appreciated that any of the embodiments described with respect to FIGS. 1 and 2A to 2R may employ any of the features of the embodiments described with respect to FIGS. 3 and 4A to 4D, and vice-verse.

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more EGMs; and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred to herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 5A:
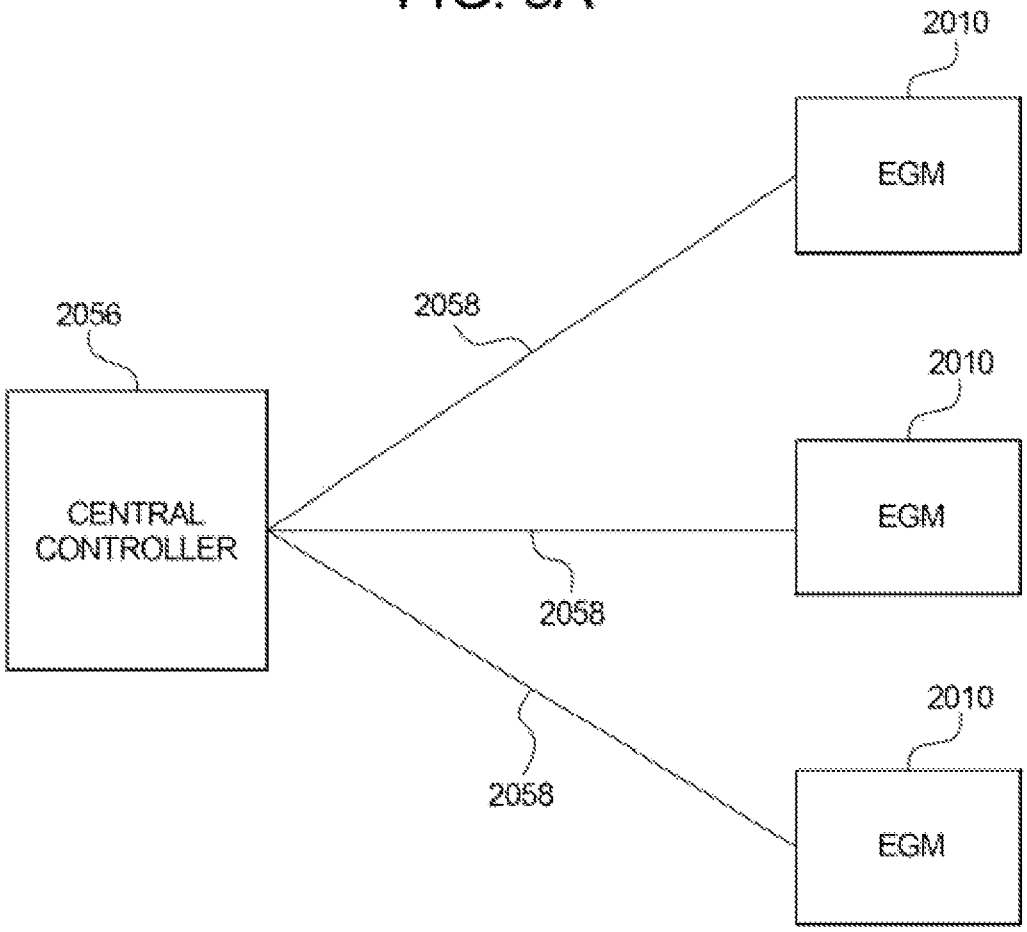
FIG. 5A is a schematic block diagram of one embodiment of a network configuration of the gaming system of the present disclosure.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 5A includes a plurality of EGMs 2010 that are each configured to communicate with a central server, central controller, or remote host 2056 through a data network 2058.

In certain embodiments in which the gaming system includes an EGM in combination with a central server, central controller, or remote host, the central server, central controller, or remote host is any suitable computing device (such as a server) that includes at least one processor and at least one memory device or storage device. As further described below, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 5B:
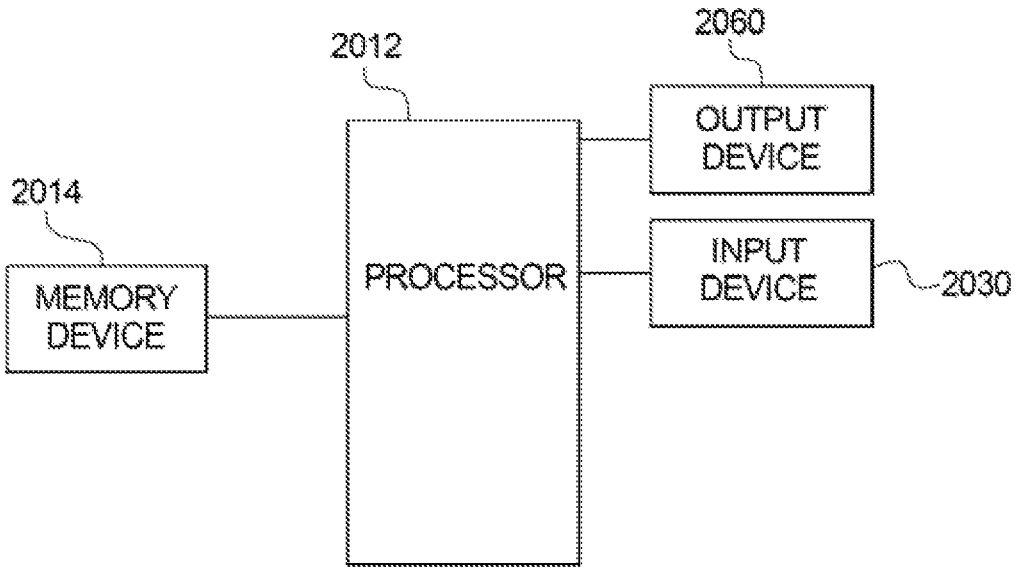
FIG. 5B is a schematic block diagram of an example electronic configuration of the gaming system of the present disclosure.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 5B illustrates an example EGM including a processor 2012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferroelectric RAM (FeRAM), and other forms as commonly understood in the gaming industry. In other embodiments, the at least one memory device includes read only memory (ROM), In certain embodiments, the at least one memory device of the EGM includes flash memory and/or EEPROM (electrically erasable programmable read only memory). The example EGM illustrated in FIG. 5B includes a memory device 2014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 6A:
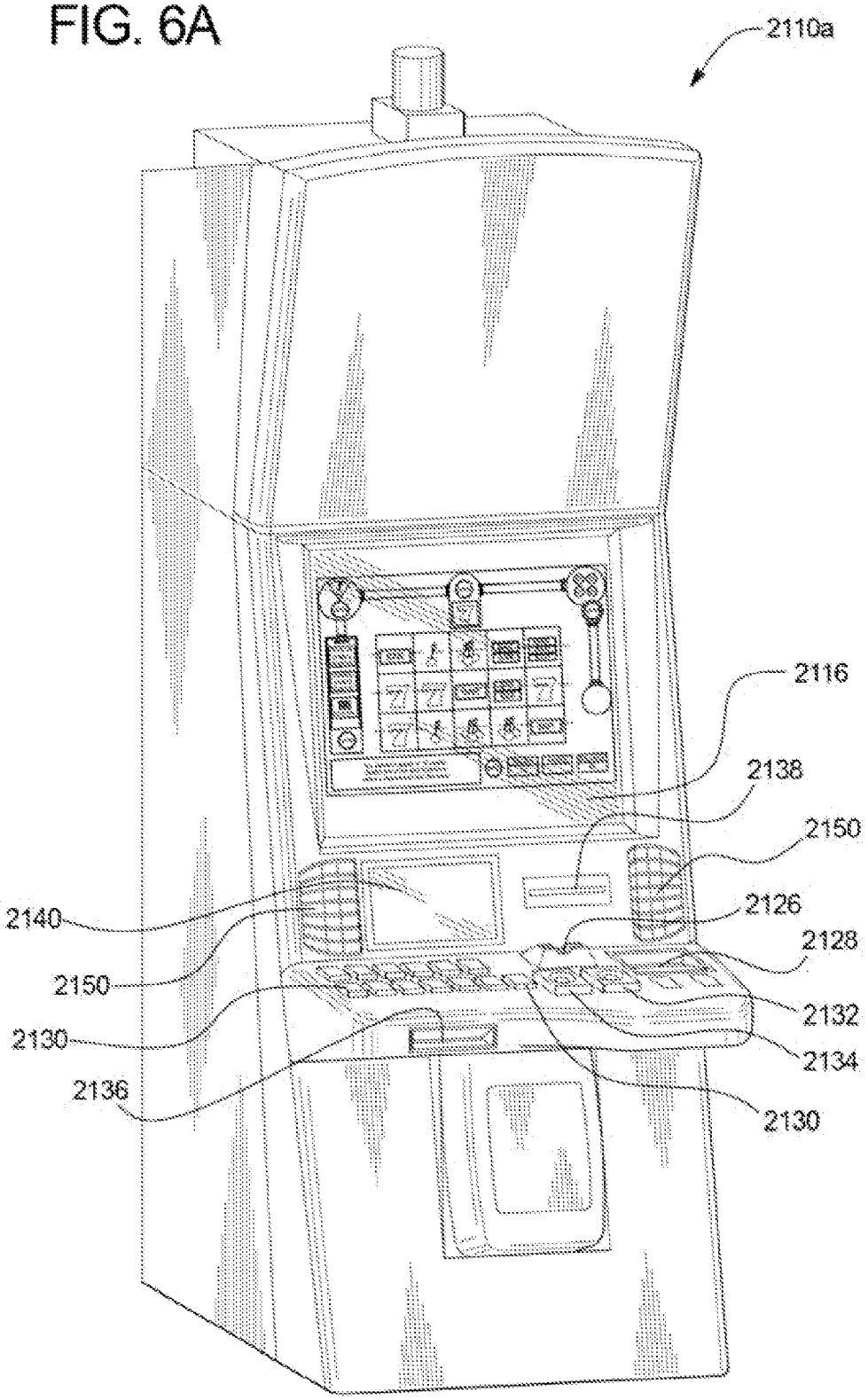
FIGS. 6A and 6B are perspective views of example alternative embodiments of the gaming system of the present disclosure.
Figure 6B:
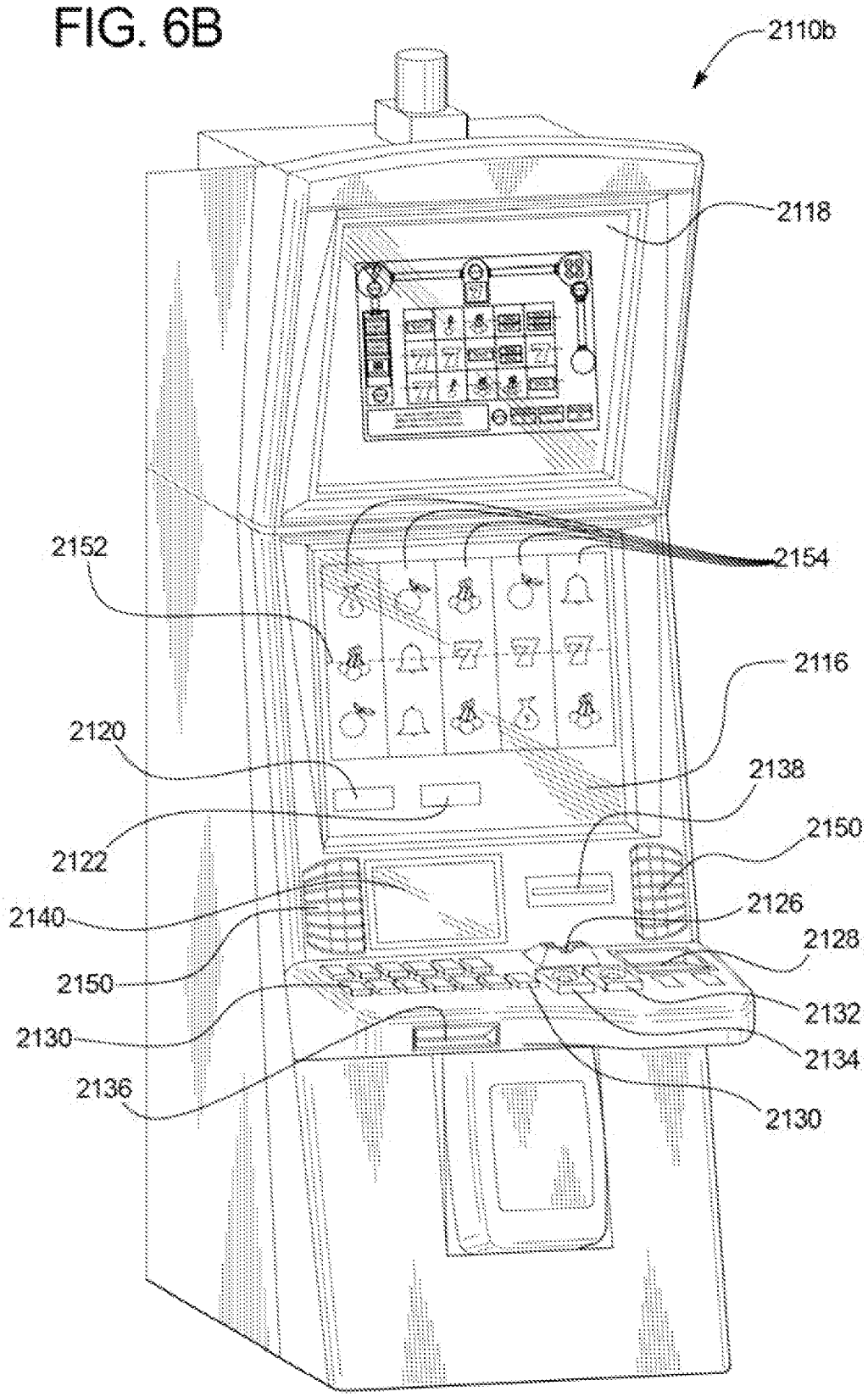

In various embodiments, the EGM includes one or more input devices. The input devices may include any suitable device that enables an input signal to be produced and received by the at least one processor of the EGM. The example EGM illustrated in FIG. 5B includes at least one input device 2030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 6A and 6B illustrate example EGMs that each include the following payment devices: (a) a combined bill and ticket acceptor 2128, and (b) a coin slot 2126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 6A and 6B each include a game play activation device in the form of a game play initiation button 32. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 6A and 6B each include a cash out device in the form of a cash out button 2134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 6A and 6B each include a card reader 2138. The card reader is configured to read a player identification card inserted into the card reader.

In various embodiments, the EGM includes one or more output devices. The example EGM illustrated in FIG. 5B includes at least one output device 2060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 6A includes a central display device 2116, a player tracking display 2140, a credit display 2120, and a bet display 2122. The example EGM illustrated in FIG. 6B includes a central display device 2116, an upper display device 2118, a player tracking display 2140, a player tracking display 2140, a credit display 2120, and a bet display 2122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 6A and 6B each include ticket generator 2136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 6A and 6B each include a plurality of speakers 2150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 6A and 6B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 6A and 6B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles. (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGMs shown in FIG. 6B includes a payline 2152 and a plurality of reels 2154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 200810020846, 200910123364, 2009/0123363, and 201010227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables an award or payout in to be obtained addition to any award or payout obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 200810070680, 2008/0176650, and 200910124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the players first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

a housing;

a plurality of input devices supported by the housing, the plurality of input devices including;

(i) an acceptor of a first physical item associated with a first monetary value, (ii) a validator configured to identify the first physical item, and (iii) a cashout button configured to receive an input to cause an initiation of a payout associated with a credit balance;

at least one display device supported by the housing;

at least one processor; and at least one memory device storing a plurality of instructions which, when executed by the at least one processor, cause the at least one processor to operate with the plurality of input devices and the at least one display device to:

(a) display a plurality of different components, wherein each of the displayed components is associated with one of a plurality of different features and each of one or more of the displayed components has a designated relationship with at least one of the other displayed components;

(b) receive an indication associated with one of the displayed components for a first play of a game;

(c) determine whether to provide the feature associated with the indicated component for said first play of the game;

(d) if it is determined to provide the feature associated with the indicated component for said first play of the game, display said first play of the game in accordance with the feature associated with the indicated component; and (e) if it is determined not to provide the feature associated with the indicated component for said first play of the game:

(i) display said first play of the game without the feature associated with the indicated component;

(ii) determine one of the other displayed components with which the indicated component has the designated relationship; and (iii) modify the feature associated with said determined component using the feature associated with the indicated component, said modified feature being available for a second subsequent play of the game.

2. The gaming system of claim 1, wherein each of the displayed components is associated with a separate spin button, and the plurality of instructions, when executed by the at least one processor, cause the at least one processor to operate with the at least one input device to receive the indication by receiving an indication of one of the spin buttons.

3. The gaming system of claim 1, wherein the plurality of instructions, when executed by the at least one processor, cause the at least one processor to operate with the at least one display device and the plurality of input devices, for the second subsequent play of the game, to:

(a) receive an indication associated with one of the displayed components for said second play of the game;

(b) if the indicated component is associated with the modified feature, determine whether to provide the modified feature associated with the indicated component for said second play of the game;

(c) if it is determined to provide the modified feature associated with the indicated component for said second play of the game, display said second play of the game in accordance with the modified feature associated with the indicated component; and (d) if it is determined not to provide the modified feature associated with the indicated component for said second play of the game:

(i) display said second play of the game without the modified feature associated with the indicated component;

(ii) determine one of the other displayed components with which the indicated component has the designated relationship; and (iii) modify the feature associated with said determined component using the modified feature associated with the indicated component, said modified feature associated with said determined component being available for a third subsequent play of the game.

4. The gaming system of claim 1, wherein an average expected payback percentage of the game is the same regardless of any provided features.

5. The gaming system of claim 1, wherein each of the displayed components has the designated relationship with at least one of the other displayed components.

6. The gaming system of claim 1, wherein the plurality of instructions, when executed by the at least one processor, cause the at least one processor to:

(a) select one of a plurality of different pools of features based on virtual currency accumulated by the player, and (b) select at least one of the plurality of different features from the selected pool.

7. A method of operating a gaming system, said method comprising:

(a) receiving, following an actuation of a wager button, a wager amount on a play of a game;

(b) causing at least one processor to execute a plurality of instructions stored in at least one memory device to operate with at least one display device to display a plurality of different components, wherein each of the displayed components is associated with one of a plurality of different features and each of one or more of the displayed components has a designated relationship with at least one of the other displayed components;

(c) receiving, via at least one input device, an indication associated with one of the displayed components for a first play of a game;

(d) causing the at least one processor to execute the plurality of instructions to determine whether to provide the feature associated with the indicated component for said first play of the game;

(e) if it is determined to provide the feature associated with the indicated component for said first play of the game, causing the at least one processor to execute the plurality of instructions to operate with the at least one display device to display said first play of the game in accordance with the feature associated with the indicated component;

(f) if it is determined not to provide the feature associated with the indicated component for said first play of the game, causing the at least one processor to execute the plurality of instructions to:

(i) operate with the at least one display device to display said first play of the game without the feature associated with the indicated component;

(ii) determine one of the other displayed components with which the indicated component has the designated relationship; and (iii) modify the feature associated with said determined component using the feature associated with the indicated component, said modified feature being available for a second subsequent play of the game; and (g) if an actuation of a cashout button is received, causing an initiation of a payout of any displayed credit balance.

8. The method of claim 7, wherein each of the displayed components is associated with a separate spin button, and wherein receiving the indication includes receiving an indication of one of the spin buttons.

9. The method of claim 7, which includes, for the second subsequent play of the game:

(a) receiving, via the at least one input device, an indication associated with one of the displayed components for said second play of the game;

(b) if the indicated component is associated with the modified feature, causing the at least one processor to execute the plurality of instructions to determine whether to provide the modified feature associated with the indicated component for said second play of the game;

(c) if it is determined to provide the modified feature associated with the indicated component for said second play of the game, causing the at least one processor to execute the plurality of instructions to operate with the at least one display device to display said second play of the game in accordance with the modified feature associated with the indicated component; and (d) if it is determined not to provide the modified feature associated with the indicated component for said second play of the game, causing the at least one processor to execute the plurality of instructions to:

(i) operate with the at least one display device to display said second play of the game without the modified feature associated with the indicated component;

(ii) determine one of the other displayed components with which the indicated component has the designated relationship; and (iii) modify the feature associated with said determined component using the modified feature associated with the indicated component, said modified feature associated with said determined component being available for a third subsequent play of the game.

10. The method of claim 7, wherein an average expected payback percentage of the game is the same regardless of any provided features.

11. The method of claim 7, wherein each of the displayed components has the designated relationship with at least one of the other displayed components.

12. The method of claim 7, which includes causing the at least one processor to execute the plurality of instructions to:

(a) select one of a plurality of different pools of features based on virtual currency accumulated by the player, and (b) select at least one of the plurality of different features from the selected pool.

13. The method of claim 7, which is provided through a data network.

14. The method of claim 13, wherein the data network is an internet.

15. A non-transitory computer readable medium storing a plurality of instructions which, when executed by at least one processor, cause the at least one processor to:

(a) receive, following an actuation of a wager button, a wager amount on a play of a game;

(b) cause at least one display device to display a plurality of different components, wherein each of the displayed components is associated with one of a plurality of different features and each of one or more of the displayed components has a designated relationship with at least one of the other displayed components;

(c) receive, via at least one input device, an indication associated with one of the displayed components for a first play of a game;

(d) determine whether to provide the feature associated with the indicated component for said first play of the game;

(e) if it is determined to provide the feature associated with the indicated component for said first play of the game, cause the at least one display device to display said first play of the game in accordance with the feature associated with the indicated component;

(f) if it is determined not to provide the feature associated with the indicated component for said first play of the game:

(i) cause the at least one display device to display said first play of the game without the feature associated with the indicated component;

(ii) determine one of the other displayed components with which the indicated component has the designated relationship; and (iii) modify the feature associated with said determined component using the feature associated with the indicated component, said modified feature being available for a second subsequent play of the game; and (g) if an actuation of a cashout button is received, cause an initiation of a payout of any displayed credit balance.

16. The non-transitory computer readable medium of claim 15, wherein each of the displayed components is associated with a separate spin button, and the plurality of instructions, when executed by the at least one processor, cause the at least one processor to operate with the at least one input device to receive the indication by receiving an indication of one of the spin buttons.

17. The non-transitory computer readable medium of claim 15, wherein the plurality of instructions, when executed by the at least one processor, cause the at least one processor to:

(a) receive, via the at least one input device, an indication associated with one of the displayed components for said second play of the game;

(b) if the indicated component is associated with the modified feature, determine whether to provide the modified feature associated with the indicated component for said second play of the game;

(c) if it is determined to provide the modified feature associated with the indicated component for said second play of the game, cause the at least one display device to display said second play of the game in accordance with the modified feature associated with the indicated component; and (d) if it is determined not to provide the modified feature associated with the indicated component for said second play of the game:

(i) cause the at least one display device to display said second play of the game without the modified feature associated with the indicated component;

(ii) determine one of the other displayed components with which the indicated component has the designated relationship; and (iii) modify the feature associated with said determined component using the modified feature associated with the indicated component, said modified feature associated with said determined component being available for a third subsequent play of the game.

18. The non-transitory computer readable medium of claim 15, wherein an average expected payback percentage of the game is the same regardless of any provided features.

19. The non-transitory computer readable medium of claim 15, wherein each of the displayed components has the designated relationship with at least one of the other displayed components.

20. The non-transitory computer readable medium of claim 15, wherein the plurality of instructions, when executed by the at least one processor, cause the at least one processor to:

(a) select one of a plurality of different pools of features based on virtual currency accumulated by the player, and (b) select at least one of the plurality of different features from the selected pool.

* * * * *

UNITED STATES PATENT AND TRADEMARK OFFICE

CERTIFICATE OF CORRECTION

PATENT NO. : 9,082,261 B2
APPLICATION NO. : 13/886984
DATED : July 14, 2015
INVENTOR(S) : Scott A. Caputo et al.

It is certified that error appears in the above-identified patent and that said Letters Patent is hereby corrected as shown below:

IN THE CLAIMS

In Claim 2, Column 39, Line 5, delete the first instance of "the".
In Claim 2, Column 39, Line 5, between "one" and "input" insert --of the--.
In Claim 2, Column 39, Line 5, replace "device" with --devices--.
In Claim 7, Column 39, Line 55, between the first instance of "a" and "play" insert --first--.
In Claim 7, Column 39, Line 66, replace "a" with --the--.
In Claim 7, Column 39, Line 67, replace "a" with --the--.
In Claim 9, Column 40, Line 35, delete "the".
In Claim 9, Column 40, Line 35, between "one" and "input" insert --of the--.
In Claim 9, Column 40, Line 35, replace "device" with --devices--.
In Claim 15, Column 41, Line 18, between the first instance of "a" and "play" insert --first--.
In Claim 15, Column 41, Line 26, replace "a" with --the--.
In Claim 15, Column 41, Line 27, replace "a" with --the--.

Signed and Sealed this
Twenty-sixth Day of July, 2016

Michelle K. Lee

Michelle K. Lee
*Director of the United States Patent and Trademark Office*